US008682236B2

(12) United States Patent
Sawaj

(10) Patent No.: US 8,682,236 B2
(45) Date of Patent: Mar. 25, 2014

(54) IMAGE FORMING APPARATUS WITH ULTRASONIC VIBRATION GENERATOR

(75) Inventor: Yuuji Sawaj, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 587 days.

(21) Appl. No.: 12/725,033

(22) Filed: Mar. 16, 2010

(65) Prior Publication Data

US 2010/0239335 A1 Sep. 23, 2010

(30) Foreign Application Priority Data

Mar. 17, 2009 (JP) ..... 2009-064463

(51) Int. Cl.
*G03G 15/16* (2006.01)

(52) U.S. Cl.
USPC ..... 399/319

(58) Field of Classification Search
USPC ..... 399/319
See application file for complete search history.

(56) References Cited

U.S. PATENT DOCUMENTS

| | | | | |
|---|---|---|---|---|
| 5,159,392 | A * | 10/1992 | Kasahara et al. | 399/309 |
| 5,890,030 | A | 3/1999 | Namekata et al. | |
| 6,163,661 | A | 12/2000 | Namekata et al. | |
| 6,516,179 | B1 | 2/2003 | Sawai et al. | |
| 6,611,672 | B2 | 8/2003 | Aoki et al. | |
| 6,618,565 | B2 | 9/2003 | Tamiya et al. | |
| 6,697,595 | B2 | 2/2004 | Kawagoe et al. | |
| 6,741,821 | B2 | 5/2004 | Sugino et al. | |
| 6,768,892 | B2 | 7/2004 | Sawai | |
| 6,785,500 | B2 | 8/2004 | Takahashi et al. | |
| 6,813,471 | B2 | 11/2004 | Sawai et al. | |
| 6,823,149 | B2 | 11/2004 | Yoshikawa et al. | |
| 6,829,450 | B2 | 12/2004 | Tamiya et al. | |
| 6,885,842 | B2 | 4/2005 | Sawai | |
| 6,901,234 | B2 | 5/2005 | Ogiyama et al. | |
| 6,983,121 | B2 | 1/2006 | Sawai | |
| 7,003,238 | B2 | 2/2006 | Yoshida et al. | |
| 7,174,124 | B2 | 2/2007 | Ishibashi et al. | |
| 7,277,662 | B2 | 10/2007 | Sawai et al. | |

(Continued)

FOREIGN PATENT DOCUMENTS

| | | |
|---|---|---|
| JP | 4-234077 | 8/1992 |
| JP | 2005338441 A * | 12/2005 |

(Continued)

OTHER PUBLICATIONS

English machine translation of JP 2005-338441 A.*

*Primary Examiner* — Walter L Lindsay, Jr.
*Assistant Examiner* — Ruth Labombard
(74) *Attorney, Agent, or Firm* — Oblon, Spivak, McClelland, Maier & Neustadt, L.L.P.

(57) ABSTRACT

An image forming apparatus includes a first endless transfer belt, first extending members, a first transfer electric generator, a secondary transfer unit disposed outboard and at least partially facing the first endless transfer belt, and an ultrasonic vibration generator, including a vibration imparting part from which ultrasonic vibrations is applied to the first endless transfer belt. The secondary transfer unit and the first endless transfer belt form a transfer nip forming a transfer electric field due to a difference in electric potential therebetween. The first transfer electric field generator contacts the first endless transfer belt at a position other than a position disposed opposite the secondary transfer unit. The vibration imparting part contacts the first endless transfer belt at a position intermediate between the first transfer electric field generator and the secondary transfer unit in a direction of rotation of the first endless transfer belt.

11 Claims, 6 Drawing Sheets

(56) References Cited

U.S. PATENT DOCUMENTS

| | | | |
|---|---|---|---|
| 7,280,792 | B2 | 10/2007 | Sawai et al. |
| 7,346,287 | B2 | 3/2008 | Ogiyama et al. |
| 7,502,583 | B2 | 3/2009 | Sawai et al. |
| 2003/0118359 | A1 | 6/2003 | Ogiyama et al. |
| 2007/0134029 | A1 | 6/2007 | Sawai |
| 2007/0269241 | A1 | 11/2007 | Sawai et al. |
| 2007/0280749 | A1 | 12/2007 | Sawai |
| 2008/0003024 | A1 | 1/2008 | Sawai |
| 2008/0166159 | A1* | 7/2008 | Watanabe et al. ..... 399/319 |
| 2009/0014288 | A1* | 1/2009 | Miyazaki et al. ..... 198/840 |
| 2009/0148201 | A1 | 6/2009 | Sawai |

FOREIGN PATENT DOCUMENTS

| | | |
|---|---|---|
| JP | 2007-140413 | 6/2007 |
| JP | 2007-241013 | 9/2007 |
| JP | 2008-242224 | 10/2008 |

* cited by examiner

IMAGE FORMING APPARATUS WITH ULTRASONIC VIBRATION GENERATOR

CROSS-REFERENCE TO RELATED APPLICATIONS

The present invention claims priority pursuant to 35 U.S.C. §119 from Japanese Patent Application No. 2009-064463, filed on Mar. 17, 2009 in the Japan Patent Office, which is hereby incorporated by reference herein in its entirety.

BACKGROUND OF THE INVENTION

1. Field of the Invention

Exemplary embodiments of the present invention relate to a copier, printer, facsimile machine, or similar image forming apparatus, and more particularly, to an image forming apparatus for transferring a toner image formed on a toner image carrying belt (e.g., an intermediate transfer belt) onto a sheet-like recording medium directly or via another toner image carrying member (e.g., a sheet conveyance member) to obtain a complete full-color image.

2. Discussion of the Related Art

In recent years, full-color image forming apparatuses for electrophotographic printing generally perform either a direct image transfer operation or an indirect image transfer operation. In the indirect transfer operation, respective single-color toner images formed on each image carrier that contacts an intermediate transfer belt are sequentially transferred onto the intermediate transfer belt by an electric field supplied by a transfer bias unit to form a composite toner image, in an operation that is referred to as primary transfer. Then, the composite toner image retained by the intermediate transfer belt is transferred onto a recording medium conveyed along the intermediate transfer belt, in an operation referred to as secondary transfer. Through the primary and secondary transfers, ultimately a full-color toner image is formed on the recording medium.

The image carrier used for the indirect transfer operation can be a drum-shaped photoconductor, a belt-shaped photoconductor, etc. By contrast, in the direct transfer operation, respective single-color toner images formed on each image carrier can be transferred onto a recording medium directly.

In an effort to further improve image quality, various techniques have been proposed to enhance toner image transferability.

One approach, for example, discloses an ultrasonic vibration generator that generates and applies ultrasonic vibrations to a transfer position of the toner image from a toner image carrying belt or an intermediate transfer belt onto a recording medium. This approach proposes a configuration that includes a corona generating unit disposed facing a surface of the toner image carrying belt extended between two extension rollers. In this configuration, a toner image is transferred onto the recording medium when the recording medium passes between the corona generating unit and the extended surface portion of the toner image carrying belt. The ultrasonic vibration generator includes a vibration imparting part that contacts an inner side of the extended surface portion of the toner image carrying belt.

This configuration further employs a non-contact transfer system. However, such a configuration uses an electrostatic force to closely contact the toner image carrying belt and a recording medium, is susceptible to poor transferability due to insufficient contact.

Another approach discloses a transfer roller and an ultrasonic vibration generator having a vibration imparting part.

The transfer roller is charged with a transfer bias having a polarity opposite that of toner, and is disposed facing one of a set of an extension rollers extending the toner image carrying belt, with the toner image carrying belt interposed between the rollers. The vibration imparting part of the ultrasonic vibration generator is disposed facing the extension roller that contacts the transfer roller via the toner image carrying belt. More particularly, the extension roller set contacting the transfer roller via the toner image carrying belt includes multiple individual rollers arranged along its axial direction. The vibration imparting members contact the inner surface of the toner image carrying belt between the multiple rollers of the extension roller set.

In the configuration according to this approach, the transfer roller is pressed against one of the multiple rollers of the extension roller set via the toner image carrying belt to form a transfer nip. As a recording medium passes through the transfer nip, stable close contact between the recording medium and the toner image carrying belt can be achieved, resulting in a stable transfer process.

In this configuration, however, multiple narrow-width rollers are arranged along an axial direction of the secondary transfer roller. Consequently, the pressure exerted by each of the rollers on the belt differs depending on whether or not the roller contacts the toner image carrying belt along the axial direction of the transfer nip, which tends to cause uneven transfer and wrinkle the recording medium as the recording medium passes therethrough. Further, it is difficult for the toner image carrying belt to vibrate easily at the transfer nip where the two rollers meet and contact each other. The upshot is that toner image transferability cannot be enhanced by applying an ultrasonic vibration to such a configuration.

It is possible to have an arrangement in which the image forming apparatus includes an ultrasonic vibration generator for applying an ultrasonic vibration to a toner image carrying belt at a different position from where the two rollers contact each other as described above. In such a configuration, a transfer-roller opposed roller and a secondary transfer roller are used. The transfer-roller opposed roller serves as an extension roller to which a transfer bias having the same polarity as that of the toner, is applied from a transfer power source. Together, the transfer-roller opposite roller and the secondary transfer roller form a contact area, which is also referred to as a secondary image transfer nip. In the secondary image transfer nip, a toner image formed on the intermediate transfer belt is transferred onto a transfer sheet serving as a recording medium. Of note is that the ultrasonic vibration generating unit includes a vibration imparting part disposed to contact the inner side of the extended surface portion of the intermediate transfer belt in an area that is located in between adjacent intermediate transfer belt rollers.

However, even this configuration was found not to improve image transferability significantly compared to a configuration without the ultrasonic vibration generator. Nor was image transferability improved when the target object onto which the toner image is transmitted is not the recording medium but another toner image carrying belt.

SUMMARY OF THE INVENTION

Exemplary aspects of the present invention have been made in view of the above-described circumstances.

Exemplary aspects of the present invention provide an image forming apparatus that can effectively enhance transferability of a toner image by applying ultrasonic vibration to an endless transfer belt, more particularly, to a transfer nip where a secondary transfer electric field is generated on the endless transfer belt.

In one exemplary embodiment, an image forming apparatus includes a first endless transfer belt, first extension members, a first transfer electric field generator, a secondary transfer unit, and an ultrasonic vibration generator. The first endless transfer belt to carry a toner image thereon after a primary image transfer operation onto a surface thereof during rotation of the first endless transfer belt. The first extension members around which the first endless transfer belt was extended. The first transfer electric field generator is disposed inboard of the first endless transfer belt. The secondary transfer unit is disposed outboard of and at least partially faces the first endless transfer belt to transfer the toner image onto a transfer medium conveyed by the secondary transfer unit. The ultrasonic vibration generator generates ultrasonic vibrations and is disposed inboard of the first endless transfer belt. The ultrasonic vibration generator includes a vibration imparting part from which the ultrasonic vibration is applied to an inner face of the first endless transfer belt. The secondary transfer unit is disposed facing and in contact with a first surface portion of the first endless transfer belt to form a transfer nip therebetween, through which the transfer medium is conveyed when the toner image is transferred onto the transfer medium in a secondary image transfer operation. The transfer nip forms a transfer electric field due to a difference in electric potential between the first endless transfer belt and the secondary transfer unit. The first transfer electric field generator contacts the inner face of the first surface portion of the first endless transfer belt in the transfer nip and presses against the first endless transfer belt at a position along the first endless transfer belt in the transfer nip other than a position disposed opposite the secondary transfer unit with the first endless transfer belt interposed therebetween. The vibration imparting part of the ultrasonic vibration generator contacts the first endless transfer belt at a position intermediate between the first transfer electric field generator and the secondary transfer unit in a direction of rotation of the first endless transfer belt.

The secondary transfer unit may include a secondary transfer roller that contacts the first endless transfer belt directly to form the transfer nip therebetween to perform the secondary image transfer operation.

At least one of the first extension members around which the first endless transfer belt may be extended may constitute the first transfer electric field generator forming multiple first transfer electric field generators. The secondary transfer roller may be disposed at a position intermediate between the multiple first transfer electric field generators in a direction of rotation of the first endless transfer belt.

The ultrasonic vibration imparting part of the ultrasonic vibration generator may be disposed at a position upstream from the secondary transfer roller in a direction of rotation of the first endless transfer belt and may contact the inner face of the first endless transfer belt in the transfer nip.

The ultrasonic vibration imparting part of the ultrasonic vibration imparting part of the ultrasonic vibration generator may be between one of the multiple first transfer electric field generators and the secondary transfer roller.

The secondary transfer unit may further include a second endless transfer belt, second extending members around which the second endless transfer belt is extended to define multiple extended surface portions therebetween including a second surface portion, and a second transfer electric field generator disposed facing and in contact with an inner face of the second endless transfer belt in the transfer nip to contact the first endless transfer belt via the second endless transfer belt. The first extended surface portion of the first endless transfer belt and the second extended surface portion of the second endless transfer belt may form the transfer nip.

At least one of the first extension members around which the first endless transfer belt may be extended may constitute the first transfer electric field generator forming multiple first transfer electric field generators. The secondary transfer electric field generator may be disposed at a position intermediate between the multiple first transfer electric field generators in a direction of rotation of the first endless transfer belt.

The ultrasonic vibration imparting part of the ultrasonic vibration generator may be disposed upstream from the second transfer electric field generator in a direction of rotation of the first endless transfer belt and contacts the inner face of the first endless transfer belt.

The ultrasonic vibration imparting part of the ultrasonic vibration generator may be disposed between one of the multiple first transfer electric field generators and the secondary transfer electric field generator.

The second extending members that extend the second endless transfer belt may serve as a driven roller. A transfer electric field may be formed in a vicinity of an entrance of the transfer nip in the direction of rotation of the first endless transfer roller to attract the toner image carried on the surface of the first endless transfer belt and the second endless transfer belt to the first endless transfer belt.

One of the first extending members may extend the first endless transfer belt at an upstream end of the first extended surface portion and serves as a first upstream roller and one of the second extending members extends the second endless transfer belt at an upstream end of the second extended surface portion and serves as a second upstream roller. A difference in electric potential between the first upstream roller and the second upstream roller may attract the toner image carried on the first endless transfer belt and the second endless transfer belt to the first endless transfer belt.

The above-described image forming apparatus may further include multiple first transfer electric field generators including the first transfer electric field generator. The vibration imparting part of the ultrasonic vibration generator may contact the first endless transfer belt between two adjacent first transfer electric field generators of the multiple first transfer electric field generators that contact the first endless transfer belt.

The secondary transfer member may include a second transfer electric field generator to contact the first endless transfer belt between the two adjacent first transfer electric field generators.

The vibration imparting part of the ultrasonic vibration generator may contact the first endless transfer belt at a position upstream of the second transfer electric field generator in the direction of rotation of the first endless transfer belt.

At least one of a surface resistivity of an outer surface and a surface resistivity of an inner surface of the first endless transfer belt may fall within a range of from $1\times10^{9}$[Ω/square] to $1\times10^{12}$ [Ω/square].

The transfer nip may transfer the toner image held on the first endless transfer belt onto a recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
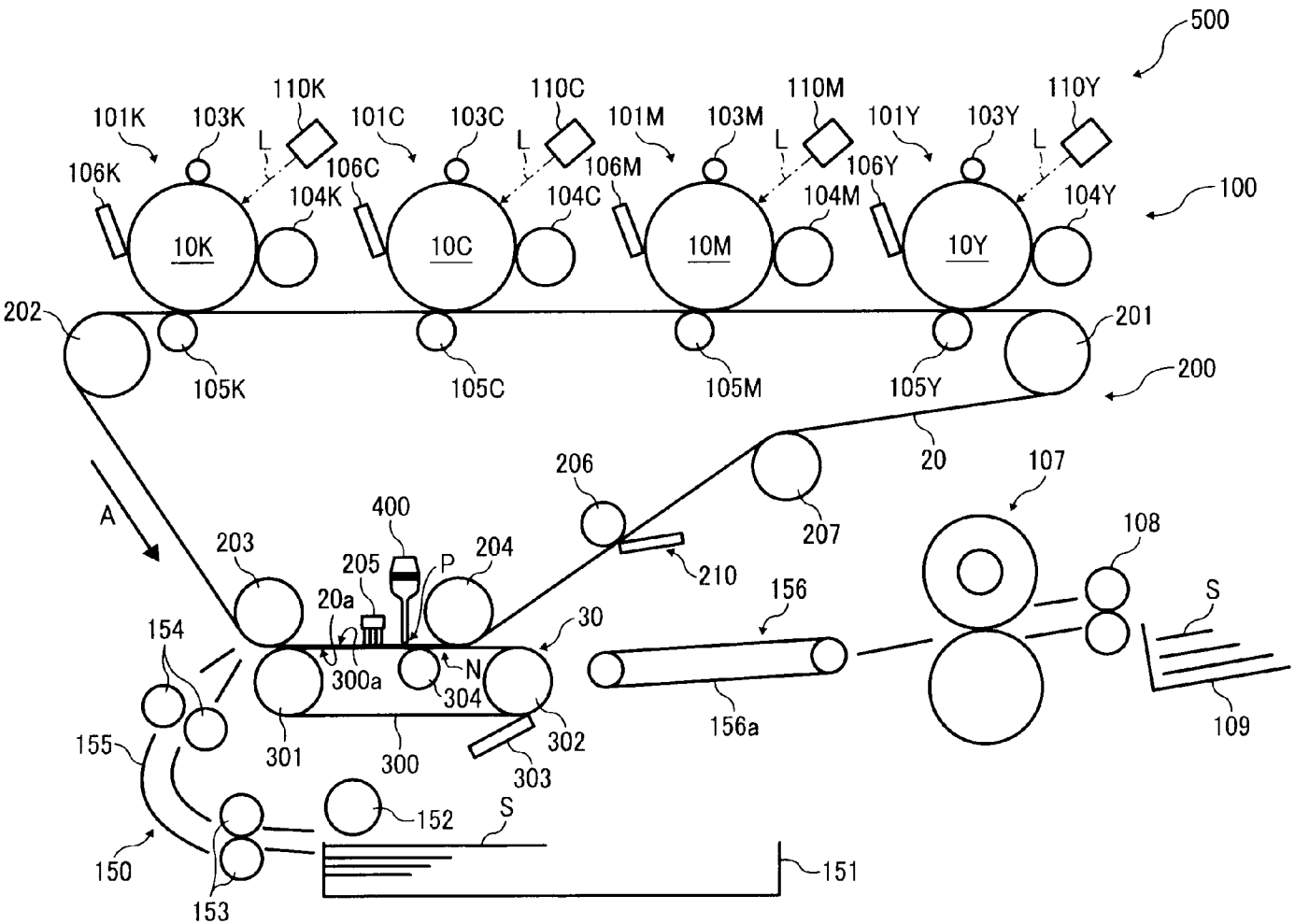
FIG. 1 is a schematic configuration of an image forming apparatus according to an exemplary embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention. The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, exemplary embodiments of the present invention are described.

Now, exemplary embodiments of the present invention are described in detail below with reference to the accompanying drawings.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus. For example, the technique of the present invention is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

FIG. 1 is a drawing of a schematic configuration of an image forming apparatus 500 according to an exemplary embodiment of the present invention.

The image forming apparatus 500 of FIG. 1 corresponds to a printer, copier, facsimile machine, etc. and employs a tandem type indirect transfer system. The image forming apparatus 500 mainly includes a tandem type image forming mechanism 100 and a transfer unit 200.

The tandem type image forming mechanism 100 of the image forming apparatus 500 includes multiple image forming units 101Y, 101M, 101C, and 101K that are disposed along an intermediate transfer belt 20 that serves as an endless intermediate transfer member.

The transfer unit 200 of the image forming apparatus 500 is located at a center part thereof. The transfer unit 200 transfers respective toner images formed by the image forming units 101Y, 101M, 101C, and 101K onto a transfer sheet S serving as a recording medium. The transfer unit 200 includes the intermediate transfer belt 20 in a form of an endless belt member. The intermediate transfer belt 20 is wound around multiple extension rollers, which are a first extension roller 201, a second extension roller 202, and a transfer area entrance roller 203, a transfer area exit roller 204, a cleaning unit supporting roller 206, and a third extension roller 207. The intermediate transfer belt 20 is rotationally conveyable in a counterclockwise direction as indicated by arrow A in FIG. 1.

A belt cleaning unit 210 is disposed facing the cleaning unit supporting roller 206 of the multiple extension rollers in FIG. 1, with the intermediate transfer belt 20 interposed between the cleaning unit supporting roller 206 and the belt cleaning unit 210. The belt cleaning unit 210 removes residual toner remaining on an outer surface or outer circumferential surface of the intermediate transfer belt 20 after a secondary image transfer operation of the toner image to the transfer sheet S.

The four image forming units 101Y, 101M, 101C, and 101K for colors of yellow (Y), magenta (M), cyan (C), and black (K), respectively, are located above the intermediate transfer belt 20, particularly above an extended area ranging between the first extension roller 201 and the second extension roller 202, and are arranged side by side along a direction of rotation of the intermediate transfer belt 20. The image forming units 101Y, 101M, 101C, and 101K are removably installable to the image forming apparatus 500. The image forming units 101Y, 101M, 101C, and 101K constitute the tandem type image forming mechanism 100.

Figure 2:
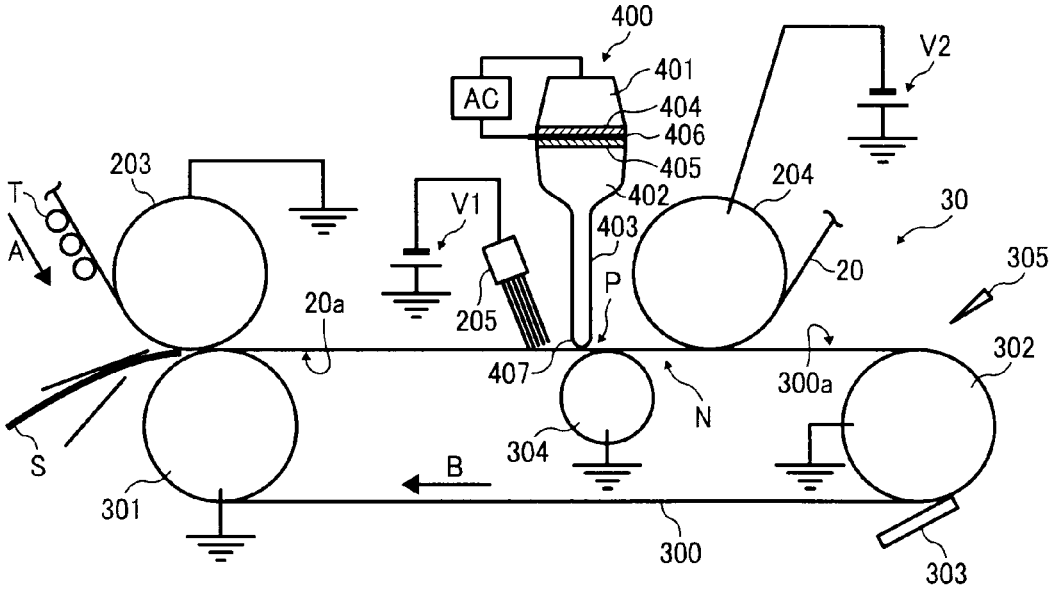
FIG. 2 is an enlarged view of a secondary transfer part of the image forming apparatus of FIG. 1 according to Exemplary Embodiment 1 of the present invention.

The image forming units 101Y, 101M, 101C, and 101K of the tandem type image forming mechanism 100 have substantially the same configuration, and therefore the configuration of the image forming unit 101 will also be explained without suffixes, as shown in FIG. 2.

The image forming unit 101 illustrated in FIG. 1 includes a drum-shaped photoconductor 10 (e.g., drum-shaped photoconductors 10Y, 10M, 100, and 10K in FIG. 1), a charging unit 103 (e.g., charging units 103Y, 103M, 103C, and 103K in FIG. 1), an optical writing unit 110 (e.g., optical writing units 110Y, 110M, 110C, and 110K in FIG. 1), and a developing unit 104 (e.g., developing units 104Y, 104M, 104C, and 104K). The photoconductor 10 serves as an image carrier for forming and carrying a toner image on a surface thereof. The charging unit 103, the optical writing unit 110, and the developing unit 104 are image forming components arranged around the photoconductor 10 for forming the toner image on the surface of the photoconductor 10.

The charging unit 103 uniformly charges the surface of the photoconductor 10. The charging unit 103 of FIG. 1 employs a charging roller serving as a charging member to which a direct current voltage is applied. As an alternative to the charging roller, the charging unit 103K can employ a charging brush, and electrifying charger, or the like.

The optical writing unit 110 is an exposing unit of a LED writing system including a light emitting diode (LED) array and a lens array arranged in an axial direction or a main scanning direction of the photoconductor 10 in FIG. 1. The optical writing unit 110 emits a laser light beam L according to an image signal to form an electrostatic latent image on the surface of the photoconductor 10. Other than the optical writing unit 110, it is also possible to use an optical writing unit of a laser scanning system including a laser beam source, a light deflector such as a rotary polygon mirror, and an image scanning optical system.

The developing unit 104 includes a developing roller that rotates while carrying a developer, and agitating and conveying member(s) that may agitate the developer and convey the developer to the developing roller. The developing unit 104 develops an electrostatic latent image formed on the surface of the photoconductor 10 with toner contained in the developer into a visible toner image. Regarding the type of developer, either single-component developer consisting essentially of toner or two-component developer consisting of toner and magnetic carrier is used.

The toner image that is formed on the surface of the photoconductor 10 through operations performed by the charging unit 103, the optical writing unit 110, and the developing unit 104 is transferred onto an outer surface of the intermediate transfer belt 20 in a primary image transfer area or an area or portion where the primary image transfer operation is performed.

A primary transfer roller 105 (e.g., primary transfer rollers 105Y, 105M, 105C, and 105K) that serves as a primary transfer member is disposed at a position in the primary image transfer area that is located opposite the photoconductor 10, with the intermediate transfer belt 20 interposed between the primary transfer roller 105 and the photoconductor 10. A transfer bias is applied to the primary transfer roller 105 with a DC power supply. In the primary image transfer area, the toner image formed on the surface of the photoconductor 10 is transferred onto the surface of the intermediate transfer belt 20 due to a difference in electric potential between the photoconductor 10 and the primary transfer roller 105 to which the transfer bias is applied.

Further, a photoconductor cleaning unit 106, which removes residual toner remaining on the surface of the photoconductor 10 after the primary image transfer operation, is provided on a downstream side of the primary image transfer area in a direction of rotation of the photoconductor 10.

When performing color image forming in the tandem type image forming mechanism 100 described above, the image forming units 101Y, 101M, 101C, and 101K for yellow (Y), magenta (M), cyan (C), and black (K) form respective single toner images of yellow (Y), magenta (M), cyan (C), and black (K) on the photoconductors 10Y, 10M, 100, and 10K, respectively. The image forming units 101Y, 101M, 101C, and 101K transfer the respective single toner images onto the intermediate transfer belt 20 to overlay the respective single toner images one on top of another to form a composite color image. When forming a black and white image, only the image forming unit 101K for black (K) operates to form a monochrome image and transfer the monochrome image onto the surface of the intermediate transfer belt 20.

By contrast, a secondary transfer mechanism 30 including a secondary image transfer area is located outboard of the intermediate transfer belt 20 and on the opposite side to the tandem type image forming mechanism 100, with the intermediate transfer belt 20 interposed therebetween. The secondary transfer mechanism 30 includes a transfer sheet conveyance belt 300.

The transfer sheet conveyance belt 300 serves as an endless transfer belt and is wound around two conveyance belt extension rollers, which are a first conveyance belt extension roller 301 and a second conveyance belt extension roller 302.

Further, a conveyance belt cleaning unit 303 is disposed facing the second conveyance belt extension roller 302 via the transfer sheet conveyance belt 300.

In the image forming apparatus 500, a secondary image transfer nip N is formed in a contact area between an extended surface portion of the outer surface of the intermediate transfer belt 20 extended between the transfer area entrance roller 203 and the transfer area exit roller 204 and an extended surface portion of an outer surface of the transfer sheet conveyance belt 300 extended between the first conveyance belt extension roller 301 and the second conveyance belt extension roller 302. A secondary transfer roller 304 is disposed in contact with an inner surface of the transfer sheet conveyance belt 300 in the secondary image transfer nip N. The transfer sheet S is conveyed to the secondary image transfer nip in synchronization of movement of the intermediate transfer belt 20 having the toner image thereon to the secondary image transfer nip N, so that the toner image on the intermediate transfer belt 20 can be transferred onto the transfer sheet S conveyed by the transfer sheet conveyance belt 300.

A sheet feeding mechanism 150 that includes a sheet feeding cassette 151 and a sheet pickup roller 152, a pair of sheet feeding rollers 153, a pair of registration rollers 154, a sheet conveyance guide path 155 is provided upstream from the secondary image transfer nip N of the secondary transfer mechanism 30 in a direction of conveyance of the transfer sheet S.

Further, a conveyance unit 156, a fixing unit 107, a pair of sheet discharging rollers 108, a sheet stacker 109 are provided downstream from the secondary image transfer nip N of the secondary transfer mechanism 30. The conveyance unit 156 conveys the transfer sheet S having the toner image transferred thereon. The fixing unit 107 fixes the transferred toner image to the transfer sheet S. The pair of sheet discharging rollers 108 discharges the transfer sheet S after fixing, to the sheet stacker 109.

Next, a detailed description is given of image forming performed by the image forming apparatus 500 having the above-described configuration.

When a start switch of an operation unit, not illustrated, is pressed, a drive motor, not illustrated, rotates the second extension roller 202 to move the intermediate transfer belt 20 in the direction A of FIG. 1. At the same time, the other two extension rollers are rotated with the one extension roller, whereby the intermediate transfer belt 20 is rotated. The rotation of the intermediate transfer belt 20 rotates the first extension roller 201, the transfer area entrance roller 203, and the transfer area exit roller 204. In this exemplary embodiment, the second extension roller 202 serves as a drive roller. However, the drive roller can be any of the first extension roller 201, the transfer area entrance roller 203, and the transfer area exit roller 204 of the multiple extension rollers.

At the same time the intermediate transfer belt 20 starts to move, the photoconductors 10Y, 10M, 10C, and 10K serving as image carriers are rotated by respective drive motors, not illustrated, in the image forming units 101Y, 101M, 101C, and 101K of the respective colors. Single color images of yellow, magenta, cyan, and black are formed on the photoconductors 10Y, 10M, 100, and 10K, respectively. According to the movement of the intermediate transfer belt 20, these single color images are sequentially transferred onto the intermediate transfer belt 20 to be overlaid one on top of another in the primary image transfer area. As a result, a composite full-color image is formed on the intermediate transfer belt 20.

Further, when the start switch is pressed, the sheet pickup roller 152 is rotated and a sheet-like recording medium such as the transfer sheet S is fed out from the sheet feeding cassette 151 and guided to the sheet conveyance guide path 155. The transfer sheet S is further conveyed toward the pair of registration rollers 154 and stopped when the transfer sheet S contacts the pair of registration rollers 154.

Thereafter, the pair of registration rollers 154 rotates in synchronization with movement of the composite full-color image held by the intermediate transfer belt 20. The transfer sheet S is conveyed to a position between the extended surface portion of the intermediate transfer belt 20 extended by the transfer area entrance roller 203 and the transfer area exit roller 204 and the extended surface portion of the transfer sheet conveyance belt 300 extended by the first conveyance belt extension roller 301 and the second conveyance belt extension roller 302. Then, the full-color image is transferred onto the transfer sheet S due to the action of a secondary transfer electric field or ultrasonic vibrations, which will be described later.

According to the rotation of the transfer sheet conveyance belt 300, the transfer sheet S passing through the secondary image transfer nip is conveyed to a position where the second conveyance belt extension roller 302 contacts the inner face of the transfer sheet conveyance belt 300 for extension, and then is further conveyed to a conveyance belt 156*a* of the conveyance unit 156.

Thereafter, the transfer sheet S enters a fixing nip formed between a pressure roller and a fixing roller provided in the fixing unit 107 according to the rotation of the conveyance belt 156*a*, and then the unfixed toner image is fixed to the transfer sheet S by application of heat and pressure. The transfer sheet S having the toner image fixed thereto is discharged out of a main body of the image forming apparatus 500 guided by the pair of sheet discharging rollers 108 to the sheet stacker 109.

Next, detailed descriptions are given of the configuration of the secondary transfer mechanism 30 of the image forming apparatus 500.

[Exemplary Embodiment 1]

FIG. 2 is an enlarged view of the secondary transfer mechanism 30 that can be applied to the image forming apparatus 500 according to a first exemplary embodiment of the present invention. Hereinafter, the first exemplary embodiment is referred to as "Exemplary Embodiment 1".

As described above, the secondary transfer mechanism 30 includes the secondary image transfer nip N formed between the extended surface portion of the intermediate transfer belt 20 extended by the transfer area entrance roller 203 and the transfer area exit roller 204 and the extended surface portion of the transfer sheet conveyance belt 300 that faces the extended surface portion of the intermediate transfer belt 20. Hereinafter, the extended surface portion of the intermediate transfer belt 20 extended by the transfer area entrance roller 203 and the transfer area exit roller 204 is referred to as an image conveyance belt extended surface portion 20*a* and the extended surface portion of the transfer sheet conveyance belt 300 facing the intermediate transfer belt 20 is referred to as a sheet conveyance belt extended surface portion 300*a*.

As shown in FIG. 2, the image forming apparatus 500 according to Exemplary Embodiment 1 further includes an upper secondary transfer power source V1, a lower secondary transfer power source V2, a voltage applying brush 205, the secondary transfer roller 304, and an ultrasonic vibration generating unit 400.

As shown in FIGS. 1 and 2, the lower secondary transfer power source V2 applies to the transfer area exit roller 204, a bias voltage having a negative charge polarity that is same as toner.

The upper secondary transfer power source V1 applies to the voltage applying brush 205, a bias voltage having a negative charge polarity that is same as toner. The voltage applying brush 205 contacts the back side of the image conveyance belt extended surface portion 20*a* and is disposed upstream from the contact position where the transfer area exit roller 204 contacts the intermediate transfer belt 20 in the direction of rotation of the intermediate transfer belt 20.

The secondary transfer roller 304 is electrically grounded. The secondary transfer roller 304 contacts the image conveyance belt extended surface portion 20*a* between the position where the transfer area exit roller 204 contacts the intermediate transfer belt 20 and the position where the voltage applying brush 205 contacts the intermediate transfer belt 20, with the transfer sheet conveyance belt 300 interposed therebetween. Then, the secondary transfer electric field is generated due to a difference in electric potential between a member to which a bias voltage is applied, e.g., the transfer area exit roller 204 and the voltage applying brush 205, and a grounded member, e.g., the secondary transfer roller 304.

As described above, the transfer area entrance roller 203 extends the intermediate transfer belt 20 at the upstream side from the secondary image transfer nip N and is electrically grounded. The first conveyance belt extension roller 301 and the second conveyance belt extension roller 302 extend the transfer sheet conveyance belt 300. Further, the second conveyance belt extension roller 302 is an insulating roller whose surface includes a high-resistance layer.

Both the first conveyance belt extension roller 301 and the second conveyance belt extension roller 302 are rotated with the transfer sheet conveyance belt 300. Since the transfer sheet conveyance belt 300 closely contacts the intermediate transfer belt 20 at the secondary image transfer nip N, the transfer sheet conveyance belt 300 is rotated with the intermediate transfer belt 20 in a direction indicated by arrow B in FIG. 2 as the intermediate transfer belt 20 rotates in a direction indicated by arrow A in FIGS. 1 and 2.

Further, the ultrasonic vibration generating unit 400 is disposed in the secondary transfer mechanism 30 of the image forming apparatus 500. Specifically, the ultrasonic vibration generating unit 400 includes vibration transmission members 401 and 402, a horn 403, piezoelectric thin films 404 and 405, an electrode 406, and a vibration imparting part 407. Details of these components will be described later.

The vibration imparting part 407 of the ultrasonic vibration generating unit 400 is disposed inboard of the intermediate transfer belt 20, contacting a position P on the back side of the image conveyance belt extended surface portion 20*a*. The position P is located between the position where the voltage applying brush 205 contacts the intermediate transfer belt 20 and the position where the secondary transfer roller 304 contacts the intermediate transfer belt 20 via the transfer sheet conveyance belt 300.

During image forming, the secondary transfer bias that has a negative charge polarity same as toner is applied to the transfer area exit roller 204 and the voltage applying brush 205, and at the same time, ultrasonic vibrations are applied at the position P by the ultrasonic vibration generating unit 400 to a toner image T held on the intermediate transfer belt 20. Application of ultrasonic vibrations can reduce an attraction force of the toner image T to the intermediate transfer belt 20. The toner image T is then transferred onto the transfer sheet S by the secondary transfer electric field.

In the secondary transfer mechanism 30 according to Exemplary Embodiment 1, the secondary image transfer nip N ranges from the position where the first conveyance belt extension roller 301 contacts the intermediate transfer belt 20 via the transfer sheet conveyance belt 300 and the transfer area exit roller 204 contacts the transfer sheet conveyance belt 300 via the intermediate transfer belt 20.

After passing the secondary image transfer nip N, the transfer sheet S is electrically discharged by a charge separation and isolation needle 305 to be separated from the transfer sheet conveyance belt 300. The secondary transfer electric field is generated in a secondary transfer electric field generating area or an area from the voltage applying brush 205 to the transfer area exit roller 204 in the direction of rotation of the intermediate transfer belt 20.

The voltage applying brush 205 includes a conductive brush, which is formed at the leading edge thereof and arranged in a vicinity of the position where the vibration imparting part 407 of the ultrasonic vibration generating unit 400 contacts the intermediate transfer belt 20 so as to slidably contact the inner surface of the intermediate transfer belt 20 as the intermediate transfer belt 20 rotates. A mylar sheet, which is not illustrated, is provided downstream from the position where the voltage applying brush 205 contacts the intermediate transfer belt 20 in the direction of rotation of the intermediate transfer belt 20 so that any component of the ultrasonic vibration generating unit 400 contacts the conductive brush of the voltage applying brush 205.

Further, as shown in FIG. 2, the secondary transfer roller 304 contacts at a position on the intermediate transfer belt 20 substantially upstream from a mid point of the contact area where the voltage applying brush 205 serving as an upstream secondary transfer bias applying member and the transfer area exit roller 204 serving as a downstream secondary transfer bias applying member on the intermediate transfer belt 20.

The position where the secondary transfer roller 304 contacts the intermediate transfer belt 20 via the transfer sheet conveyance belt 300 is different from the position where the vibration imparting part 407 of the ultrasonic vibration generating unit 400 contacts the intermediate transfer belt 20, and the secondary transfer roller 304 does not face the vibration imparting part 407 of the ultrasonic vibration generating unit 400.

If the secondary transfer roller 304 and the vibration imparting part 407 are arranged to face each other via the intermediate transfer belt 20 and the transfer sheet conveyance belt 300, ultrasonic vibrations are applied to the intermediate transfer belt 20 on a fixed area or an area supported by the secondary transfer roller 304 pressed against the intermediate transfer belt 20. With this condition, the ultrasonic vibrations are not transmitted well and cannot contribute to the improvement of the toner image transferability, compared to the condition described in Exemplary Embodiment 1 that does not included a supporting member that supports the vibration imparting part 407 via the intermediate transfer belt 20 and the transfer sheet conveyance belt 300.

In the configuration of Exemplary Embodiment 1, the secondary image transfer nip N is formed by one of the extended surface portions of the intermediate transfer belt 20 that serves as a toner image carrying belt and the contact area of the surface of the transfer sheet conveyance belt 300 that serves as a transfer sheet conveyance member.

Further, the transfer area exit roller 204 and the voltage applying brush 205, both of which serve as the secondary transfer bias applying members, contact the inner side of the intermediate transfer belt 20. More specifically, the transfer area exit roller 204 and the voltage applying brush 205 contact the image conveyance belt extended surface portion 20*a* that serves as an extended surface portion of the intermediate transfer belt 20 where the secondary image transfer nip N is formed. In the secondary image transfer nip N, the secondary transfer roller 304 that functions as a sheet transfer electric generating member contacts the image conveyance belt extended surface portion 20*a* via the transfer sheet conveyance belt 300 serving as a secondary transfer member.

Further, the position where the transfer area exit roller 204 contacts the intermediate transfer belt 20 and the position where the voltage applying brush 205 contacts the intermediate transfer belt 20 in the direction of rotation of the intermediate transfer belt 20 are different from the position where the secondary transfer roller 304 contacts the intermediate transfer belt 20 via the transfer sheet conveyance belt 300.

Further, the vibration imparting part 407 of the ultrasonic vibration generating unit 400 serving as an ultrasonic vibration generator contacts the intermediate transfer belt 20 between the position where the voltage applying brush 205 contacts the intermediate transfer belt 20 and the position where the secondary transfer roller 304 contacts the intermediate transfer belt 20 via the transfer sheet conveyance belt 300.

Thus, the vibration imparting part 407 of the ultrasonic vibration generating unit 400 contacts the position between the voltage applying brush 205 and the secondary transfer roller 304 on the intermediate transfer belt 20, and therefore the ultrasonic vibrations can be applied to the intermediate transfer belt 20 within the area where the secondary transfer electric field is formed by the difference in electric potential between the voltage applying brush 205 and the secondary transfer roller 304.

[Exemplary Embodiment 2]

Figure 3:
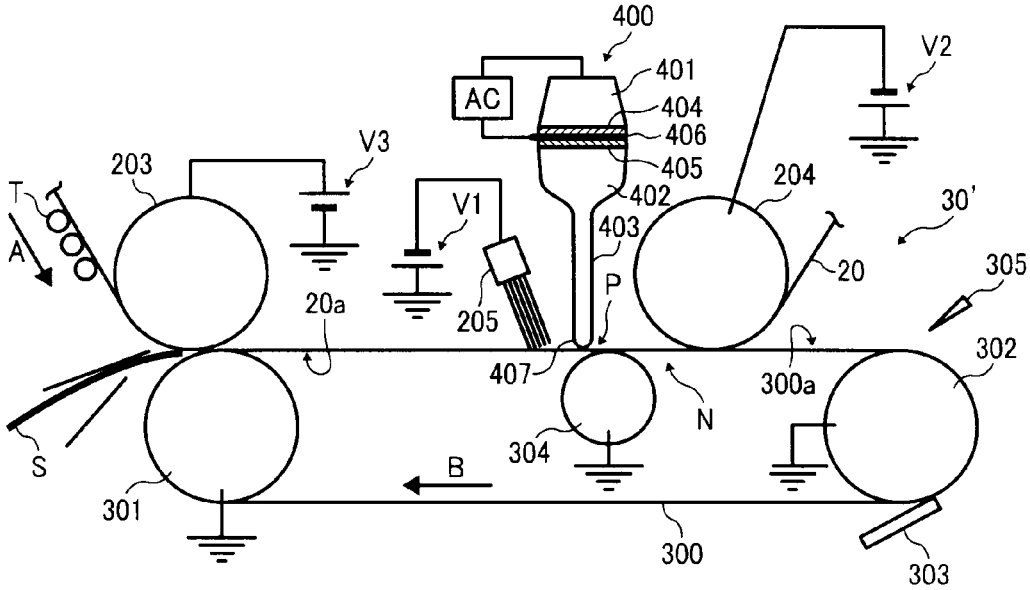
FIG. 3 is an enlarged view of a secondary transfer part of the image forming apparatus of FIG. 1 according to Exemplary Embodiment 2 of the present invention.

FIG. 3 is an enlarged view of a secondary transfer mechanism 30' that can be applied to the image forming apparatus 500 according to a second exemplary embodiment of the present invention. Hereinafter, the second exemplary embodiment is referred to as "Exemplary Embodiment 2".

As shown in FIG. 3, the configuration of Exemplary Embodiment 2 is similar to the configuration of Exemplary Embodiment 1. Except that the configuration of the secondary transfer mechanism 30' according to Exemplary Embodiment 2 further includes a transfer area entrance roller power source V3 that applies a bias voltage having a charge polarity opposite the charge polarity of toner to the transfer area entrance roller 203.

In the configuration of Exemplary Embodiment 2, the transfer area entrance roller power source V3 applies a bias voltage of +1500 volts [V] to the transfer area entrance roller 203.

Thus, by applying the bias voltage having the charge polarity opposite that of toner to the transfer area entrance roller 203, the toner image T is attracted to the intermediate transfer belt 20 at the entrance of the secondary image transfer nip N. This application of the bias voltage to the transfer area entrance roller 203 at the entrance of the secondary image transfer nip N has prevented toner scattering on a toner image with texts, specifically toner scattering on a two-color toner image based on RGB image data effectively, compared to the configuration of Exemplary Embodiment 1.

Further, by applying this bias voltage, the electrostatic adhesiveness between the intermediate transfer belt 20, the transfer sheet conveyance belt 300, and the transfer sheet S have increased, the ultrasonic vibrations have been applied to the toner image more effectively, and good transfer performance without nonuniformity over the entire image has been achieved.

[Modified Embodiment 1]

Next, a description is given of a first modified exemplary embodiment of a secondary transfer mechanism 30M. The configuration of the secondary transfer mechanism 30M is different from the above-described configurations of the image forming apparatus 500 of Exemplary Embodiments 1 and 2. Hereinafter, the first modified exemplary embodiment is referred to as "Modified Exemplary Embodiment 1".

Figure 4:
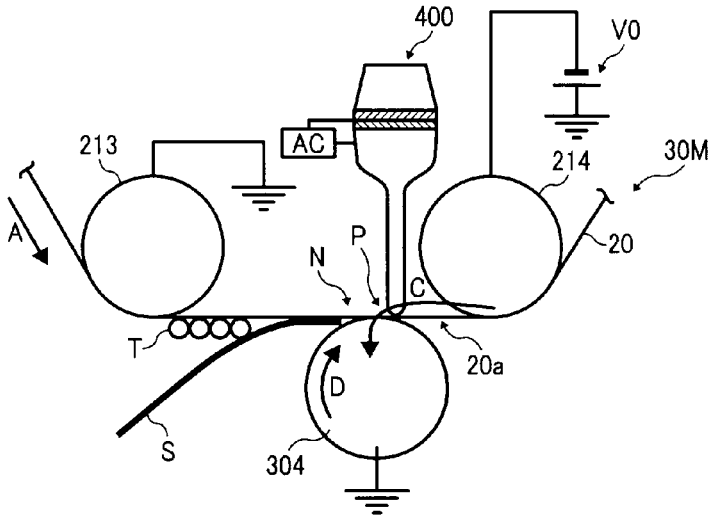
FIG. 4 is an enlarged view of a secondary transfer part of the image forming apparatus of FIG. 1 according to Modified Embodiment 1 of the present invention.

FIG. 4 is an enlarged view of a modified configuration of the secondary transfer mechanism 30M according to Modified Exemplary Embodiment 1. Elements or components of the secondary transfer mechanism 30M according to Modified Exemplary Embodiment 1 may be denoted by the same reference numerals as those of the secondary transfer mechanisms 30 and 30' according to Exemplary Embodiments 1 and 2 and the descriptions thereof are omitted or summarized.

Figure 7:
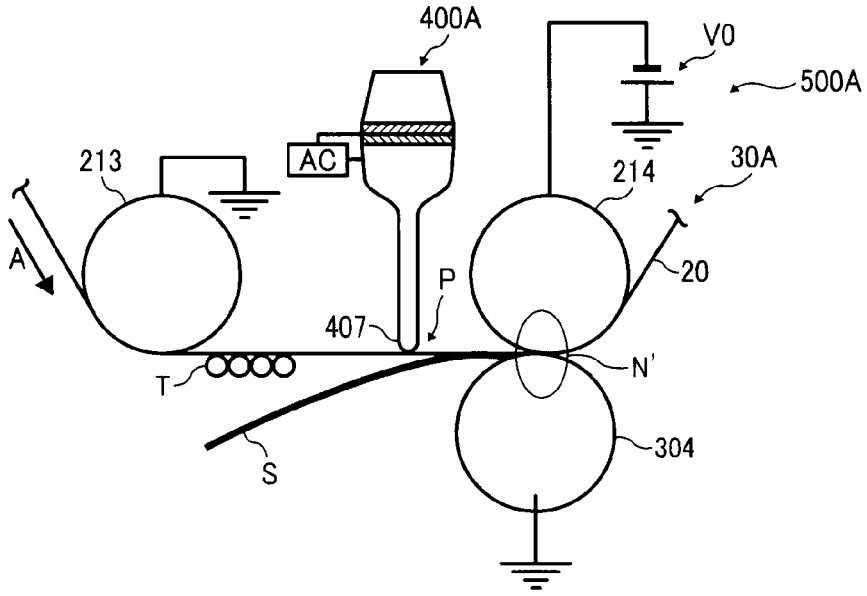
FIG. 7 is an enlarged view of a secondary transfer part of Comparative Example 1.

As shown in FIG. 4, the configuration of Modified Exemplary Embodiment 1 is similar to the configuration of Comparative Embodiment shown in FIG. 7. Except that the position where the secondary transfer roller 304 contacts the intermediate transfer belt 20 is changed to a further upstream side in the rotation of the intermediate transfer belt 20, so that the vibration imparting part 407 of the ultrasonic vibration generating unit 400 contacts a position between a transfer roller opposed roller 214 and the secondary transfer roller 304 on the intermediate transfer belt 20.

In this configuration of the secondary transfer mechanism 30M, a transfer electric current is provided in a direction as indicated by arrow C in FIG. 4, to the surface of the intermediate transfer belt 20, between the transfer roller opposed roller 214 to which a transfer power source V0 applies a bias voltage and the grounded secondary transfer roller 304 to form a transfer electric field, so that the toner image T carried by the intermediate transfer belt 20 is transferred onto the transfer sheet S.

The secondary transfer roller 304 is rotated with the rotation of the intermediate transfer belt 20. That is, the secondary transfer roller 304 closely contacts the intermediate transfer belt 20 at the secondary image transfer nip N, and therefore the secondary transfer roller 304 is rotated with the intermediate transfer belt 20 in a direction indicated by arrow D in FIG. 4 as the intermediate transfer belt 20 rotates in the direction A.

In the configuration of the secondary transfer mechanism 30M according to Modified Exemplary Embodiment 1, the secondary image transfer nip N is formed at a contact position between an extended surface portion extended by an upstream extension roller 213 and the transfer roller opposed roller 214 of the intermediate transfer belt 20 and the surface of the secondary transfer roller 304. The transfer roller opposed roller 214 serving as a transfer electric field generating member contacts the intermediate transfer belt 20 from the back side of the image conveyance belt extended surface portion 20*a*, which is the extended surface portion of the intermediate transfer belt 20 forming the secondary image transfer nip N. In the secondary image transfer nip N, the secondary transfer roller 304 serving as the transfer sheet transfer electric field generating member contacts the image conveyance belt extended surface portion 20*a* directly.

Further, the position where the transfer roller opposed roller 214 contacts the intermediate transfer belt 20 in the direction of rotation of the intermediate transfer belt 20 is different from the position where the secondary transfer roller 304 contacts the intermediate transfer belt 20. Further, the vibration imparting part 407 of the ultrasonic vibration generating unit 400 contacts the intermediate transfer belt 20 between the position where the transfer roller opposed roller 214 contacts the intermediate transfer belt 20 and the position where the secondary transfer roller 304 contacts the intermediate transfer belt 20.

Thus, when the vibration imparting part 407 of the ultrasonic vibration generating unit 400 contacts the intermediate transfer belt 20 between the transfer roller opposed roller 214 and the secondary transfer roller 304, ultrasonic vibrations can be applied to the intermediate transfer belt 20, within the area where the secondary transfer electric field is generated due to the difference in electric potential between the transfer roller opposed roller 214 and the secondary transfer roller 304.

Accordingly, this configuration can effectively enhance the toner image transferability, compared to Comparative Example 1 shown in FIG. 7 and Comparative Example 2 shown in FIGS. 8 and 9, which will be described later.

The configuration of Modified Exemplary Embodiment 1 illustrates a system employing an indirect transfer operation in which the secondary transfer roller 304 contacts the intermediate transfer belt 20, on an area where no member or component is disposed facing the secondary transfer roller 304 via the intermediate transfer belt 20. In such a system having the indirect transfer operation, the vibration imparting part 407 may contact the area between the transfer roller opposed roller 214 and the secondary transfer roller 304 from the back or inner side of the intermediate transfer belt 20, as shown in FIG. 4. In this configuration, however, a distance between the position where the secondary transfer roller 304 contacts the intermediate transfer belt 20 and the position where the transfer roller opposed roller 214 contacts the intermediate transfer belt 20 may increase.

Specifically, to arrange the vibration imparting part 407 to contact the intermediate transfer belt 20 within the area where the secondary transfer electric field is generated, the vibration imparting part 407 may need to contact the area between the contact position of the photoconductor transfer electric field generating member to the intermediate transfer belt 20 and the contact position of the secondary transfer member (e.g., the secondary transfer roller 304) to the intermediate transfer belt 20.

In Modified Exemplary Embodiment 1, the photoconductor transfer electric field generating member corresponds to the transfer roller opposed roller 214. Therefore, even if the vibration imparting part 407 of the ultrasonic vibration generating unit 400 is arranged in a vicinity of the contact position of the transfer roller opposed roller 214 to the intermediate transfer belt 20, the vibration imparting part 407 may be positioned away from the contact position of the transfer roller opposed roller 214 by at least the distance equal to the radius of the transfer roller opposed roller 214 from the position where the transfer roller opposed roller 214 contacts the intermediate transfer belt 20. Therefore, the distance between the position where the secondary transfer roller 304 contacts the intermediate transfer belt 20 and the position where the transfer roller opposed roller 214 contacts the intermediate transfer belt 20 may be longer than an addition of the radius of the transfer roller opposed roller 214 and the width required for disposing the vibration applying part 407. According to the reasons above, in the configuration of Modified Exemplary Embodiment 1, the distance between the position where the secondary transfer roller 304 contacts the intermediate transfer belt 20 and the position where the transfer roller opposed roller 214 contacts the intermediate transfer belt 20 increases.

Figure 5:
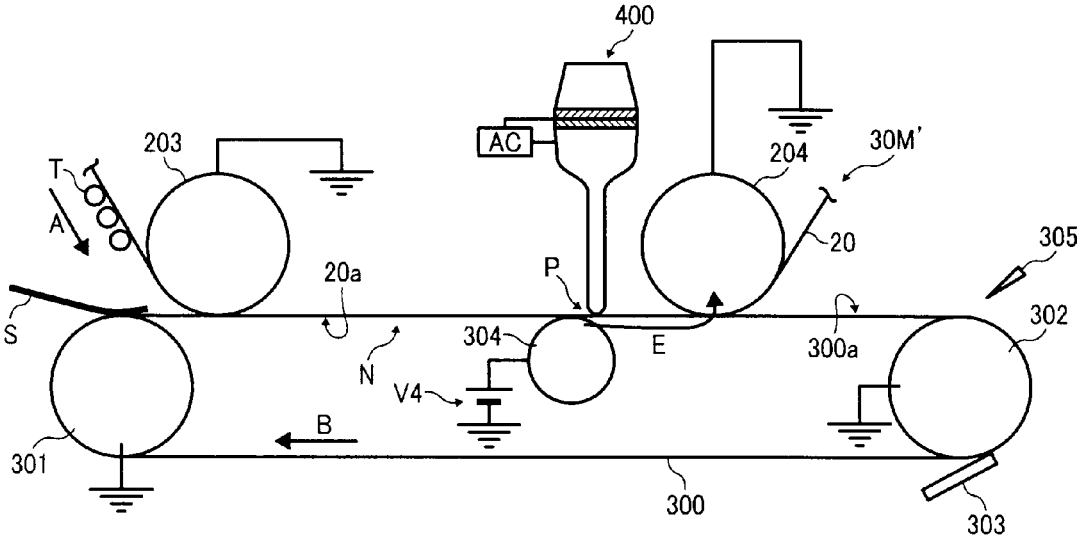
FIG. 5 is an enlarged view of a secondary transfer part of the image forming apparatus of FIG. 1 according to Modified Embodiment 2 of the present invention.

As shown in the configuration of FIG. 5, as the distance between the position where the secondary transfer roller 304 contacts the intermediate transfer belt 20 and the position where the transfer roller opposed roller 214 contacts the intermediate transfer belt 20 increases, a distance of which the electric current flows through the surface of the intermediate transfer belt 20 increases, and as a result, the surface resistivity of the intermediate transfer belt 20 prevents the flow of the electric current for transfer.

In the configuration of Modified Exemplary Embodiment 1, a transfer bias is applied to either the secondary transfer roller 304 or the transfer roller opposed roller 214 to flow the transfer electric current in the area between the secondary transfer roller 304 and the transfer roller opposed roller 214 on the intermediate transfer belt 20 for performing the secondary image transfer operation. Therefore, the transfer bias and the transfer electric current value depend on the distance between the secondary transfer roller 304 and the transfer roller opposed roller 214 and the surface resistivity of the intermediate transfer belt 20. As the surface resistivity of the intermediate transfer belt 20 increases, the flow of the electric current is more resisted when performing a constant current control. This can increase the applied voltage, and as a result, the capacity of the power source can exceed its limits. Therefore, in the configuration of Modified Exemplary Embodiment 1, the constant current control of the secondary transfer bias may resist the flow of electric current, which can prevent the secondary image transfer operation.

Therefore, the volume resistivity and surface resistivity of the intermediate transfer belt 20 are determined according to voltages and electric currents in an acceptable range, and consequently, the surface resistivity of the intermediate transfer belt 20 in the configuration of Modified Exemplary Embodiment 1 employing the indirect transfer operation may be low. However, if the surface resistivity of the intermediate transfer belt 20 is low, the primary image transfer can have disadvantages according to the reasons described below.

Specifically, if the surface resistivity of the intermediate transfer belt 20 is low, the electric current flows smoothly through the surface of the intermediate transfer belt 20. Therefore, a primary transfer bias applying member (e.g., the primary transfer roller 105 in FIG. 1) applies a bias voltage to a wide area of the contact position, and the distribution of the transfer electric field can be wider. Generally in a primary transfer area, the primary transfer roller 105 is disposed to contact the intermediate transfer belt 20 at a position downstream from a primary image transfer nip formed between the photoconductor 10 and the intermediate transfer belt 20 so as to reduce the transfer electric field at the entrance of the primary transfer nip. However, even with this arrangement, if the distribution of the transfer electric field becomes wider by setting the surface resistivity of the intermediate transfer belt 20 to a lower value, the transfer electric field at the entrance of the primary image transfer nip increases. Since the toner image formed on the photoconductor 10 travels across a gap formed between the photoconductor 10 and the intermediate transfer belt 20 before being transferred onto the intermediate transfer belt 20, toner scattering can occur more frequently. In addition, if the surface resistivity of the intermediate transfer belt 20 is low, the electric current flows across four primary transfer rollers 105 serving as multiple primary transfer bias application members, and it is likely to cause defect in bias control due to mutual interference of the electric current for the multiple primary transfer rollers 105.

[Modified Exemplary Embodiment 2]

Next, a description is given of a second modified embodiment of a secondary transfer mechanism 30M' in a configuration different from the above-described configurations of the image forming apparatus 500. Hereinafter, the second modified embodiment is referred to as "Modified Exemplary Embodiment 2".

FIG. 5 is an enlarged view of a modified configuration of a secondary transfer mechanism 30M' according to Modified Exemplary Embodiment 2. Elements or components of the secondary transfer mechanism 30M' according to Modified Exemplary Embodiment 2 may be denoted by the same reference numerals as those of the secondary transfer mechanism 30M according to Modified Exemplary Embodiment 1 and the descriptions thereof are omitted or summarized.

As shown in FIG. 5, the configuration of Modified Exemplary Embodiment 2 is similar to the configuration of Modified Exemplary Embodiment 1 shown in FIG. 4. Except that the secondary transfer roller 304 contacts the intermediate transfer belt 20 via the transfer sheet conveyance belt 300 that is extended by the first conveyance belt extension roller 301 and the second conveyance belt extension roller 302. The configuration of Modified Exemplary Embodiment 2 also includes a secondary transfer roller power source V4 to apply a bias voltage having a charge polarity opposite the charge polarity of toner, which is a negative polarity, to the secondary transfer roller 304, and a secondary transfer bias applying member (e.g., the secondary transfer roller 304) contacts the back side of the transfer sheet conveyance belt 300. At least the second conveyance belt extension roller 302, which is one of the rollers extending the transfer sheet conveyance belt 300, is an insulating roller having a high-resistance layer as a surface thereof.

Further, the transfer area exit roller 204 serving as a transfer electric field generating member is electrically grounded, and a secondary transfer electric field is formed due to the difference in electric potential between the secondary transfer roller 304 and the transfer area exit roller 204.

Similar to Modified Exemplary Embodiment 1, in the configuration of Modified Exemplary Embodiment 2, an extension roller on the downstream side of the image conveyance belt extended surface portion 20*a*, which corresponds to the transfer area exit roller 204 in Modified Exemplary Embodiment 2 and serves as a transfer electric field generating member, and the vibration imparting part 407 of the ultrasonic vibration generating unit 400 contacts at a position between the transfer area exit roller 204 and the secondary transfer roller 304 on the intermediate transfer belt 20. According to the configuration, the distance between the position of the photoconductor transfer electric generating member (e.g., the transfer area exit roller 204) contacting the intermediate transfer belt 20 and the sheet transfer member (e.g., the secondary transfer roller 304) increases, which is likely to cause defects on toner images, similar to Modified Exemplary Embodiment 1.

As noted in the description of Modified Exemplary Embodiment 1, if the surface resistivity of the intermediate transfer belt 20 decreases, the toner scattering can occur easily before the primary image transfer nip. However, with the configuration of Modified Exemplary Embodiment 2, by reducing not the surface resistivity of the intermediate transfer belt 20 but the surface resistivity of the transfer sheet conveyance belt 300, the flow of electric current from the secondary transfer roller 304 to the transfer area exit roller 204 can be enhanced, thereby effectively forming the secondary transfer electric field.

In the configuration of Modified Exemplary Embodiment 2, the surface resistivity of the transfer sheet conveyance belt 300 is lower than the surface resistivity of the intermediate transfer belt 20. In this case, when a bias voltage is applied to the secondary transfer roller 304, the electric current flows through the surface of the transfer sheet conveyance belt 300 in a direction indicated by arrow E shown in FIG. 5, and therefore can further flow from the transfer sheet conveyance belt 300 toward the intermediate transfer belt 20 at the position where the transfer area exit roller 204 contacts the transfer sheet conveyance belt 300 via the intermediate transfer belt 20. Therefore, a high transfer electric field to the toner image is generated at the position where the transfer area exit roller 204 is disposed facing the transfer sheet conveyance belt 300 via the intermediate transfer belt 20, and a low transfer electric field to the toner image is generated at the position where the vibration imparting part 407 of the ultrasonic vibration generating unit 400 contacts the inner surface of the intermediate transfer belt 20. Consequently, the configuration of Modified Exemplary Embodiment 2 can provide only a small effect of enhancement of the toner image transferability by applying the ultrasonic vibrations.

Modified Exemplary Embodiment 2 shows the configuration in which the bias voltage having the charge polarity opposite the charge polarity of toner is applied to the secondary transfer roller 304 while the transfer area exit roller 204 is electrically grounded, as shown in FIG. 5.

However, as an alternative configuration, the secondary transfer roller 304 can be electrically grounded and the bias voltage having the charge polarity same as the charge polarity of toner can be applied to the transfer area exit roller 204. With this configuration, even though the path of the flow of electric current from the transfer area exit roller 204 to the secondary transfer roller 304 is reversed, i.e. the electric current flows in a direction opposite the direction E in FIG. 5, the electric current itself flows through the surface of the transfer sheet conveyance belt 300. Therefore, similar to the original configuration of Modified Exemplary Embodiment 2, a high transfer electric field to the toner image is generated at the position where the transfer area exit roller 204 is disposed facing the transfer sheet conveyance belt 300 via the intermediate transfer belt 20. Consequently, a low transfer electric field to the toner image is generated at the position where the vibration imparting part 407 of the ultrasonic vibration generating unit 400 contacts the inner surface of the intermediate transfer belt 20, and as a result, this configuration can provide only a small effect of enhancement of the toner image transferability by applying the ultrasonic vibrations, compared to the configurations of Exemplary Embodiments 1 and 2.

In the configuration of Modified Exemplary Embodiment 2, the secondary image transfer nip N is formed by the image conveyance belt extended surface portion 20*a*, which is one of the extended surface portions of the intermediate transfer belt 20 serving as the endless toner image carrying belt, and the contact area of the extended surface portion 300*a* of the transfer sheet conveyance belt 300 serving as a secondary transfer member.

Further, the transfer area exit roller 204 serving as a transfer electric field generating member contacts the inner side of the intermediate transfer belt 20, and more specifically, contacts the image conveyance belt extended surface portion 20*a* as a photoconductor transfer nip extended surface portion that serves as an extended surface portion of the intermediate transfer belt 20 where the secondary image transfer nip N is formed. In the secondary image transfer nip N, the secondary transfer roller 304 serving as a sheet transfer electric field generating member contacts the image conveyance belt extended surface portion 20*a* via the transfer sheet conveyance belt 300 serving as a transfer sheet conveyance member.

Further, the position where the transfer area exit roller 204 contacts the intermediate transfer belt 20 in the direction of rotation of the intermediate transfer belt 20 is separated from the position where the secondary transfer roller 304 contacts the intermediate transfer belt 20 via the transfer sheet conveyance belt 300. Further, the vibration imparting part 407 of the ultrasonic vibration generating unit 400 contacts the intermediate transfer belt 20, between the position where the transfer area exit roller 204 contacts the intermediate transfer belt 20 and the position where the secondary transfer roller 304 contacts the intermediate transfer belt 20 via the transfer sheet conveyance belt 300.

Thus, since the vibration imparting part 407 of the ultrasonic vibration generating unit 400 contacts the position P between the transfer area exit roller 204 and the secondary transfer roller 304 on the intermediate transfer belt 20, the ultrasonic vibrations can be applied to the intermediate transfer belt 20, within the area where the secondary transfer electric field is formed by the difference in electric potential between the transfer area exit roller 204 and the secondary transfer roller 304.

The configurations of Exemplary Embodiments 1 and 2 include the voltage applying brush 205 that serves as a secondary transfer electric field generating member used for contacting the vibration imparting part 407 and that is disposed between the contact position of the photoconductor transfer electric field generating member (e.g., the transfer area exit roller 204) contacts the intermediate transfer belt 20 and the transfer sheet conveyance member (e.g., the secondary transfer roller 304) contacts the intermediate transfer belt 20. Therefore, the contact position of the vibration imparting part 407 to the intermediate transfer belt 20 can be adjacent the contact position of the voltage applying brush 205 to the intermediate transfer belt 20. This allows the contact position of the secondary transfer roller 304 to the transfer sheet conveyance belt 300 to be arranged adjacent the contact position of the voltage applying brush 205. Consequently, this configuration can prevent defects in Modified Exemplary Embodiments 1 and 2 caused by an increase in distance between the contact position of the photoconductor transfer electric field generating member and the transfer sheet conveyance member.

Next, a description is given of the ultrasonic vibration generating unit 400, referring to FIG. 2.

The ultrasonic vibration generating unit 400 is provided to apply ultrasonic vibrations to the intermediate transfer belt 20 forming a transfer nip so as to enhance the toner image transferability. The configuration of the ultrasonic vibration generating unit 400 includes, but is not limited to, the configuration shown in FIG. 2.

As previously described, the ultrasonic vibration generating unit 400 incorporated in the image forming apparatus 500 includes the vibration transmission members 401 and 402, the horn 403, the piezoelectric thin films 404 and 405, the electrode 406, and the vibration imparting part 407.

The ultrasonic vibration generating unit 400 incorporated in the image forming apparatus 500 is formed by a bolt-clamped Langevin transducer and an exponential horn that serves as an amplitude amplifier. The Langevin transducer is formed by piezoelectric thin films 404 and 405 having a same thickness are overlaid such that one direction of electrostriction is opposite the other, both ends of the two piezoelectric thin films 404 and 405 are sandwiched by the vibration transmission members 401 and 402, which are generally formed by material having high vibration transmission ability, for example, metal such as aluminum and titanium, and bolt-clamped with bolts, not illustrated.

Langevin transducer has a length of $\lambda/2$ (half-wave) and can amplify vibration by resonance. Similarly, the horn 403 also uses resonance to amplify vibration.

The horn 403 has a length same as the width of the intermediate transfer belt 20 in an axial direction or a direction perpendicular to the direction of rotation of the intermediate transfer belt 20. The horn 403 also includes a slit or slits in an axial direction thereof to prevent interference in the axial direction and apply vibration across the entire width of the intermediate transfer belt 20 uniformly. The vibration transmission members 401 and 402 and the horn 403 are electrically conducted via bolts, not illustrated.

The electrode 406 is disposed between the piezoelectric thin films 404 and 405 serving as transducers and a sine wave alternate current (AC) voltage is applied between the electrode 406 and the vibration transmission member 401, thereby generating ultrasonic vibrations due to electrostriction.

The vibration imparting part 407 that corresponds to the tip of the horn 403 applies the vibration amplified by the piezoelectric thin films 404 and 405 and the horn 403 in a direction perpendicular to the surface of the intermediate transfer belt 20.

The ultrasonic vibration generating unit 400 preferably applies, to the intermediate transfer belt 20, frequency of vibration in a range of from 20 kilohertz [kHz] to 100 kilohertz [kHz] and amplitude at peak-to-peak in a range of from 0.1 micrometers [μm] to 10 micrometers [μm]. To enhance transferability by applying vibration to a toner image carrying belt, it is necessary to apply vibration by an amount that the toner on the toner image held on the intermediate transfer belt 20 cannot follow the vibrations, so as to reduce the attachment force of toner to the toner image carrying belt. Therefore, the frequency of the ultrasonic vibrations to be applied to the intermediate transfer belt 20 is 20 kilohertz [kHz] or greater. If the frequency of the ultrasonic vibrations to be applied to the intermediate transfer belt 20 is too large, the ultrasonic vibrations can trigger toner scattering. Therefore, the frequency of ultrasonic vibrations to be applied to the intermediate transfer belt 20 is set to 100 kilohertz [kHz] or smaller.

Further, the length of the horn 403 that serves as a resonance member varies according to the settings of the frequency used, i.e., as the frequency to be used is set higher, the length of the horn 403 can be shorter. Therefore, to downsize the apparatus, a high frequency of vibration may be set. However, if the frequency is too high, the toner cannot follow the vibrations, and therefore the effect of enhancement of toner image transferability may decrease. To prevent this, it may need to consider the size of the image forming apparatus (e.g., the image forming apparatus 500) and set an appropriate frequency for the image forming apparatus.

Next, a description is given of the controls of the secondary transfer bias to be applied to the transfer area exit roller 204 and the voltage applying brush 205 for forming the secondary transfer electric field of the image forming apparatus 500.

The transfer electric field control includes the constant current control and the constant voltage control. If an object that receives an image is a sheet of paper, the resistance of the sheet of paper largely changes depending on type, thickness, and size of the sheet of paper, environmental condition, and the like, and therefore it is preferable that the secondary transfer bias applied to the transfer area exit roller 204 and the voltage applying brush 205 is subject to constant-current controlling. In an exemplary embodiment of the present invention, voltages to be applied to the transfer area exit roller 204 and the voltage applying brush 205 may have the conditions identical to each other or different from each other.

In the image forming apparatus 500 according to an exemplary embodiment of the present invention, the transfer area exit roller 204 and the voltage applying brush 205, which are two of the multiple secondary transfer bias applying members, are disposed on the inner surface of the intermediate transfer belt 20. However, three or more of the multiple secondary transfer bias applying members can alternatively be disposed.

It is, however, difficult to provide the same distance between each of the multiple secondary transfer bias applying members and an opposed member (e.g., the secondary transfer roller 304 in the image forming apparatus 500) to which the electric current from the multiple secondary transfer bias applying members can easily flow. With the different distances, it is difficult to have an equal resistance between the secondary transfer bias applying member and the opposed member, for example, the resistance of the intermediate transfer belt 20. Since each secondary transfer bias applying member has different resistances with respect to the opposed member, it is preferable that the secondary transfer bias voltage has the constant current control.

When the resistance between the secondary transfer bias applying member and the opposed member increases, the applied voltage in the configuration having the constant current control can increase, and as a result, the capacity of power source reaches the upper limit. Therefore, it is necessary to perform the control considering the upper limit value of the capacity of power source and provide different set current values. In addition, with consideration of the separation ability of the transfer sheet S, it is possible to set the secondary transfer electric field on the upstream side to be high and the secondary transfer electric field on the downstream side to be low, according to the system.

The image forming apparatus 500 employs the voltage applying brush 205 serving as an upstream secondary transfer bias applying member and the transfer area exit roller 204 serving as a downstream secondary transfer bias applying member. However, the secondary transfer bias applying member of this configuration is not limited thereto. For example, a roller, a brush, a film or other conventional secondary transfer bias applying member can be used as the secondary transfer bias applying member used for the present invention. When the secondary transfer bias applying member contacts the intermediate transfer belt 20 adjacent the position where the vibration imparting part 407 of the ultrasonic vibration generating unit 400 contacts the intermediate transfer belt 20, as shown in FIG. 2, a brush or film member is preferably used as a secondary transfer bias applying member.

When the secondary image transfer nip is formed on the extended surface portion 20*a* of the intermediate transfer belt 20, as in the configuration of the image forming apparatus 500, either one of the two extension rollers that extend the intermediate transfer belt 20 at both ends of the extended surface portion forming the secondary image transfer nip can also be used as a secondary transfer bias applying member, which is preferable to reduce the size of the image forming apparatus 500.

Further, when either one of the two extension rollers is used as the secondary transfer bias applying member, as in the configuration of the image forming apparatus 500, the extension roller disposed on the downstream side in a direction of rotation of the intermediate transfer belt 20 (e.g., the transfer area exit roller 204 in the image forming apparatus 500) of the two extension rollers is more preferably used according to the reasons described below.

Specifically, if the extension roller (e.g., the transfer area exit roller 204) disposed on the downstream side of the extended surface portion of the intermediate transfer belt 20 is used as the secondary transfer bias applying member, the transfer bias is applied to the extension roller disposed in the area after the transfer sheet S closely contacts the intermediate transfer belt 20 that holds a toner image thereon. Therefore, even if an electric field is generated across the gap at the end of the secondary image transfer nip, the toner image may be affected only slightly.

By contrast, if an extension roller (e.g., the transfer area entrance roller 203) disposed on the upstream side of the extended surface portion 20*a* of the intermediate transfer belt 20 is used as the secondary transfer bias applying member, the transfer bias is applied to the extension roller disposed in the area before the transfer sheet S closely contacts the intermediate transfer belt 20 with the toner image thereon, and therefore an electric field may be generated at the entrance of the secondary image transfer nip, resulting in occurrence of defective image such as transfer scattering.

The examples of the materials for the secondary transfer bias applying member include conductive materials such as metal materials can be used and electrically grounded via resistance. Further, the examples of the materials for a roller-shaped secondary transfer bias applying member include a metal shaft bar surrounded by a rubber material having a given resistivity. When the secondary transfer bias applying member is a transfer bias applying roller (e.g., the transfer area exit roller 204), the roller-shaped member has a configuration such that an elastic layer made of, for example, an elastic material including an ion conducting agent and a conductive agent is added.

The specific examples of the materials used for the elastic layer that covers the metal shaft of the transfer bias applying member include rubbers having an ion-conducting property, such as epichlorohydrin rubbers, urethane rubbers, nitrile—butadiene rubbers, acrylic rubbers, chloroprene rubbers, fluorine-containing rubbers, nitrile rubbers, norbornene rubbers, etc., and other rubbers such as natural rubbers (NR), butadiene rubbers, isoprene rubbers, styrene—butadiene rubbers (SBR), ethylene—propylene—diene rubbers (EPDM), butyl rubbers, silicone rubbers, etc. These materials can be used alone or in combination. Among these materials, epichlorohydrin rubbers are preferably used because of having a good combination of ionic conductivity and physical properties.

A typical conductive brush can be used as the voltage applying brush 205. For example, conductivity of such a conductive brush is obtained by adding carbon black as conductive agent to resin fibers such as acrylic resin, polyester resin, nylon resin, or the like. Various brush hairs or fibers having a conduction of uniform dispersion, a shape of core of a pencil, or a shape in which both sides of a conductive layer is sandwiched by resin materials according to the shape of conductive agent when the conductive agent was added can be used.

Next, a description is given of the intermediate transfer belt 20.

The intermediate transfer belt 20 may have a single-layered structure or a multi-layered structure. In addition, the method for preparing the intermediate transfer belt 20 is not particularly limited, and any known methods such as dipping methods, centrifugal molding methods, extrusion molding methods, inflation methods, coating methods, and spraying methods can be used.

The surface layer, which is a thin layer of the composite belt, can be prepared by any suitable known methods. Specific examples of typical methods are, but not limited to, spray coating methods, dip coating methods, and flow coating methods. When using a centrifugal molding method, for example, after molding and drying the upper layer, the base layer is formed, dried, and cured.

Suitable materials for use in preparing a base layer of the intermediate transfer belt 20 include polyimide resins, polyamide imide resins, polycarbonate resins, polyphenylene sulfide resins, polyurethane resins, polybutylene terephthalate resins, polyvinylidene fluoride resins, polysulfone resins, polyether sulfone resins, polymethyl pentene resins, and combinations thereof. In view of the strength, polyimide resins, and polyamide imide resins are preferably used. It is preferable to add an electro conductive carbon black to the intermediate transfer belt to control the resistivity thereof.

Next, an example of the centrifugal molding method for preparing the intermediate transfer belt 20 using a polyimide resin will be explained.

Polyimide resins are typically prepared by subjecting an aromatic polycarboxylic anhydride (or a derivative thereof) and an aromatic diamine to a condensation reaction. Because of having a rigid main chain, such polyimide resins are insoluble in solvents and are not melted even when heated. Therefore, at first, a polyamic acid (i.e., a polyamide acid or an aromatic polyimide precursor), which can be dissolved in an organic solvent, is prepared by reacting an anhydride with an aromatic diamine. After the polyamic acid (or the like) is molded by any known methods, the molded polyamic acid is heated or subjected to a chemical treatment to perform dehydration and ring formation (i.e., imidization). Thus, a molded polyimide resin is prepared.

Specific examples of the aromatic polycarboxylic anhydrides include ethylenetetracarboxylic dianhydride, cyclopentanetetracarboxylic dianhydride, pyromellitic anhydride, 3,3',4,4'-benzophenonetetracarboxylic dianhydride, 3,3',4,4'-biphenyltetracarboxylic dianhydride, etc., but are not limited thereto. These compounds can be used alone or in combination.

Specific examples of the aromatic diamines include m-phenylenediamine, o-phenylenediamine, p-phenylenediamine, m-aminobenzylamine, p-aminobenzylamine, 4,4'-diaminodiphenyl ether, 3,3'-diaminodiphenyl ether, 3,4'-diaminodiphenyl ether, etc., but are not limited thereto. These compounds can be used alone or in combination.

By polymerizing an aromatic polycarboxylic anhydride with a diamine, which are mixed in a molar ratio of approximately 1:1, in a polar organic solvent, a polyimide precursor (i.e., a polyamic acid) can be prepared.

Suitable solvents for use as the polar organic solvent includes any known polar organic solvents, which can dissolved a polyamic acid, and N,N-dimethylformamide and N-methyl-2-pyrrolidone are preferably used.

Although it is easy to synthesize a polyamic acid, various polyimide varnishes in which a polyamic acid is dissolved in an organic solvent are marketed. Specific examples of such varnishes include TORAYNEECE (from Toray Industries Inc.), U-VARNISH (from Ube industries, Ltd.), RIKACOAT (from New Japan Chemical Co., Ltd.), OPTOMER (from Japan Synthetic Rubber Co., Ltd.), SE812 (from Nissan Chemical Industries, Ltd.), CRC8000 (from Sumitomo Bakelite Co., Ltd.), etc.

Specific examples of the resistivity controlling agents for use in the polyimide resins include powders of electroconductive resistivity controlling agents such as carbon black, graphite, metals (e.g., copper, tin, aluminum, and indium), metal oxides (e.g., tinoxide, zincoxide, titaniumoxide, indium oxide, antimony oxide, bismuth oxide, tin oxide doped with antimony, and indium oxide doped with tin), etc.

In addition, ion-conducting resistivity controlling agents can also be used. Specific examples thereof include tetraalkylammonium salts, trialkylbenzyl, ammonium salts, alkylsulfonic acid salts, alkylbenzenesulfonic acid salts, alkylsulfates, esters of glycerin and a fatty acid, esters of sorbitan and a fatty acid, polyoxyethylenealkylamine, esters of polyoxyethylenealiphatic alcohols, alkylbetaine, lithium perchlorate, etc., but are not limited thereto.

Among these resistivity controlling agents, carbon black is preferably used for polyimide resins.

The thus prepared polyamic acid is heated at a temperature of from approximately 200 degrees Celsius to approximately 350 degrees Celsius to be converted to a polyimide resin.

By contrast, when continuous melt extrusion molding methods are used, thermoplastic resins are preferably used. Specific examples of such thermoplastic resins include polyethylene, polypropylene, polystyrene, polybutylene terephthalate (PBT), polyethylene terephthalate (PET), polycarbonate (PC), ethylene—tetrafluoroethylene copolymers (ETFE), polyvinylidene fluoride (PVdF), etc.

Melt molding methods are not limited but broadly classified into continuous melt extrusion molding methods, injection molding methods, blow molding methods, inflation molding methods, etc. Among these methods, continuous melt extrusion molding methods are preferably used for preparing a seamless belt.

Carbon black is typically used as an electroconductive agent for the intermediate transfer belt 20. The dispersion state of a carbon black, which is prepared by kneading, in a belt formed by a melt extrusion method is typically inferior to that in a belt formed by a centrifugal method using a dispersion in which a carbon black is dispersed in high conductive agents. Therefore, the variation of resistivity of a belt formed by a melt extrusion method is typically larger than that of a belt formed by a centrifugal method.

A material suitable for the surface layer of the intermediate transfer belt 20 is not limited to a specific material but is demanded to be a material to reduce an adhesion force of toner to the outer circumference of the intermediate transfer belt 20 and to increase secondary transferability.

Suitable examples of materials of the surface layer of the intermediate transfer belt 20 are, but not limited to, resin materials such as polyurethane, polyester, polyamide, etc. A coat layer including these resin materials can be obtained as a resin coat film by a curing agent such as isocyanato, melamine, silane coupling agent, and carbodiimide. Further, by filling a mold releasing filler, such as polytetrafluoroethylene (PTFE), silica, molybdenum disulfide, and carbon black, the coat layer can increase mold releasing performance of the surface thereof to improve the cleaning performance and prevent accumulation of toner and discharge product material. Further, the coat layer can include conductive fillers (conductive agents), such as conductive carbon black, tin oxide, zinc oxide to control the resistance. Further, the coat layer can include surface active agents, such as fluorine-containing surface active agent, silicone-containing surface active agent, nonion-containing surface active agent to uniformly mixing and dispersing these fillers.

One or more polyurethane resin, polyester resin, epoxy resins, etc. can be used as materials of the surface layer of the intermediate transfer belt 20. Further, lubrication must be high by reducing the surface energy. Therefore, one or more powders or particles of fluorine resin, fluorine compound, carbon fluoride, titanium dioxide, and silicon carbide can be dispersed in the layer; or the same kinds of the above material whose particle diameter is different can be dispersed in the layer. In addition, similar to fluorine containing rubber materials, the surface energy can be reduced by forming a fluorine-rich layer on the outer circumference of the intermediate transfer belt 20 by applying heat treatment. Carbon black can be used for resistance controlling.

Next, a description is given of examples of manufacturing the intermediate transfer belt 20 and the transfer sheet conveyance belt 300 according to an exemplary embodiment of the present invention. Specific examples of typical materials and manufacturing methods of the intermediate transfer belt 20 and the transfer sheet conveyance belt 300 used in the image forming apparatus 500 according to an exemplary embodiment are, but not limited to, the following.

The intermediate transfer belt 20 and the transfer sheet conveyance belt 300 used in the image forming apparatus 500 according to an exemplary embodiment are formed by polyimide resin, manufactured in a belt shape using a centrifugal molding technique and applied different resistivities.

Polymerization of 3,3',4,4'-biphenyl tetracarboxylic acid dianhydride as the aromatic polyhydric carboxylic anhydride, p-phenylenediamine as the aromatic diamine, and N-methyl-2-pyrrolidone as the organic polar solvent was performed to obtain a polyamic acid solution. Acetylene black was added to the polyamic acid solution, to the amount of 17% to the solid content density thereof. The mixture is agitated with Aquamizer manufactured by HOSOKAWA MICRON CORPORATION. Thus, polyamic acid having 18% of solid content as precursor of polyimide resin was prepared.

The polyamic acid obtained as above was molded into a ring or loop through a centrifugal molding method while a metal cylindrical mold having a diameter of 375 mm was rotated at a speed of 100 rpm, and polyamic acid having a solid content of 19% was uniformly applied to an inner surface of the cylindrical mold by a dispenser. Next, the cylindrical mold was rotated at a speed of 1000 rpm for 5 minutes to level the polyamic acid. Then, the rotation speed was reduced to 300 rpm, and the cylindrical mold was gradually heated to 130 degrees Celsius. The polyamic acid was dried for 40 minutes and was solidified.

After the solidification, the cylindrical mold was stopped to rotate and heated to 350 degrees Celsius, to cause imide ring-closing. Thus, imidization was completed and polyimide coating was obtained.

Next, the cylindrical mold was cooled to room temperature and the polyimide coating was removed therefrom. Both edges of the polyamic coating were cut off so that the polyamic coating had a width of 365 mm. From the above, a seamless intermediate transfer belt 20 having a layer thickness of 80 micrometers [μm] was produced. The resistance of the intermediate transfer belt 20 was adjusted by a conductive additive amount (carbon black). The resistance can be adjusted under the primary dry condition, however, adjustment of resistance for one or more digits may need to be performed according to type and amount of carbon black.

Further, a belt position guide that is formed by polyurethane resin and has a thickness of 1.0 millimeters [mm] and a width of 5 millimeters [mm] is provided with double-faced adhesive tape at both ends in a widthwise direction of an outer circumferential surface of the intermediate transfer belt 20.

[Test]

Tests were conducted to examine whether the transferability of an image can be improved by applying ultrasonic vibrations to the intermediate transfer belt 20 and how other image characteristics are affected.

Table 1 shows test results obtained by apparatuses having a configuration of Exemplary Embodiment 1 or Exemplary Embodiment 2 and an apparatus having a configuration of Modified Exemplary Embodiment 2 as Comparative Condition 5.

Table 2 shows tests results obtained by apparatuses having a configuration of Modified Exemplary Embodiment 1, Comparative Example 1 according to FIG. 7 and Comparative Example 2, which is described below.

TABLE 1

| | | EC1 | EC2 | EC3 | EC4 | CC5 |
|---|---|---|---|---|---|---|
| FIG | | FIG. 2 | FIG. 3 | FIG. 3 | FIG. 3 | FIG. 5 |
| Intermediate Transfer Belt 20 | Material | Polyimide | Polyimide | Polyimide | Polyimide | Polyimide |
| | Thickness | 80 [μm] | 80 [μm] | 80 [μm] | 80 [μm] | 80 [μm] |
| | Surface Resistivity | 10.5 | 10.5 | 9.2 | 11.8 | 11.5 |
| | Volume Resistivity | 8.8 | 8.8 | 8.5 | 9.5 | 9.1 |
| Transfer Sheet Conveyance Belt 300 | Material | Polyimide | Polyimide | Polyimide | Polyimide | Polyimide |
| | Thickness | 80 [μm] | 80 [μm] | 80 [μm] | 80 [μm] | 80 [μm] |
| | Surface Resistivity | 10.5 | 10.5 | 10.5 | 10.5 | 9.5 |
| | Volume Resistivity | 8.8 | 8.8 | 8.8 | 8.8 | 8.5 |
| Transfer area exit roller 204 | Material | NBR Coated | NBR Coated | NBR Coated | NBR Coated | Foamed Polyurethane |
| | Resistance | 6.8 | 6.8 | 7.5 | 8 | 6.5 |
| | Bias | 30 [μA] | 30 [μA] | 27 [μA] | 25 [μA] | Grounded |
| Voltage Applying Brush 205 | Material | Conductive Acrylic Fiber | Conductive Acrylic Fiber | Conductive Acrylic Fiber | Conductive Acrylic Fiber | |
| | Bias | 35 [μA] | 35 [μA] | 35 [μA] | 35 [μA] | |
| Transfer Area Entrance Roller 203 | Material | Metal | Metal | Metal | Metal | Metal |
| | Resistance | — | — | — | — | — |
| | Bias | Grounded | Plus 1500 [V] | Plus 2000 [V] | Plus 1200 [V] | Grounded |
| First Conveyance Belt Extension Roller 301 | Material | Metal | Metal | Metal | Metal | Metal |
| | Resistance | — | — | — | — | — |
| | Bias | Grounded | Grounded | Grounded | Grounded | Grounded |
| Second Conveyance | Material | Insulant | Insulant | Insulant | Insulant | Insulant |
| | Resistance | — | — | — | — | — |

TABLE 1-continued

| | | EC1 | EC2 | EC3 | EC4 | CC5 |
|---|---|---|---|---|---|---|
| Belt Extension Roller 302 | Bias | Grounded | Grounded | Grounded | Grounded | Grounded |
| Secondary Transfer Roller 304 | Material | Foamed Polyurethane | Foamed Polyurethane | Foamed Polyurethane | Foamed Polyurethane | Polyurethane |
| | Resistance | 6.5 | 6.5 | 6 | 5.5 | 7.5 |
| | Bias | Grounded | Grounded | Grounded | Grounded | 35 [μA] |
| Ultrasonic Vibration Generating Unit 400 | Frequency | 39.8 [kHz] | 39.8 [kHz] | 66.8 [kHz] | 28.8 [kHz] | 39.8 [kHz] |
| | Output | 10 [W] | 10 [W] | 13 [W] | 10 [W] | 10 [W] |
| Embossed Paper Transferability | | 4.5 | 4.5 | 5 | 4.5 | 2.5 |
| Two-color Toner Scattering | | 4 | 5 | 4.5 | 5 | 4 |
| Uniform Transferability | | 4 | 5 | 5 | 5 | 4 |
| Others | | | | | | |

In Table 1, "EC" represents Example Condition, and "CC" represents Conductive Condition.

TABLE 2

Figure 9:
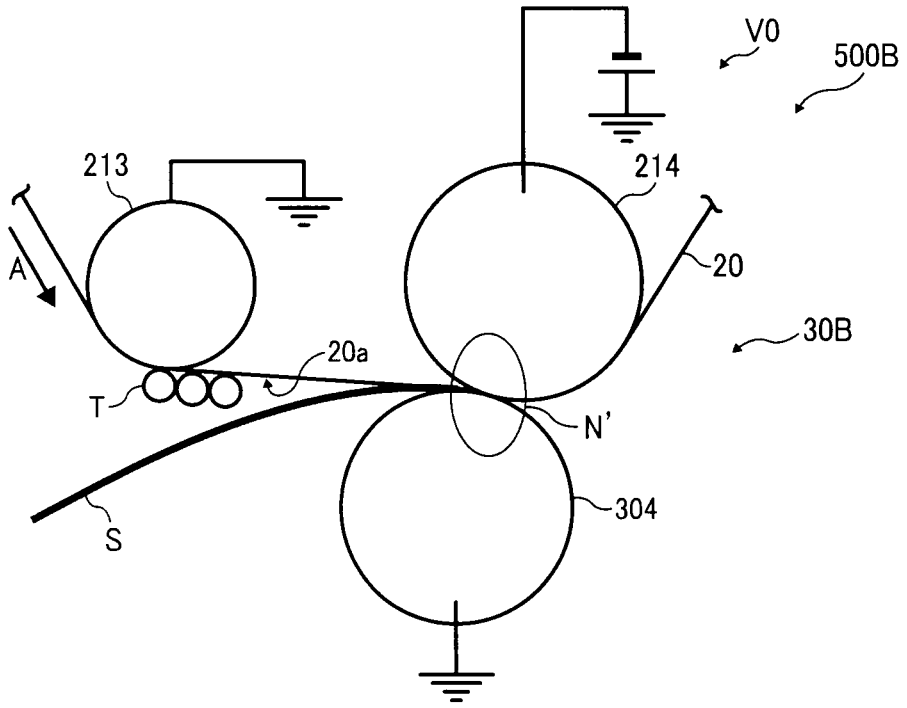
FIG. 9 is an enlarged view of a secondary transfer part of the image forming apparatus of FIG. 8 of Comparative Example 2.

| | | CC1 | CC2 | CC3 | CC4 |
|---|---|---|---|---|---|
| Structure | | FIG. 9 | FIG. 7 | FIG. 4 | FIG. 4 |
| Intermediate Transfer Belt 20 | Material | Polyimide | Polyimide | Polyimide | Polyimide |
| | Thickness | 80 [μm] | 80 [μm] | 80 [μm] | 80 [μm] |
| | Surface Resistivity | 11.5 | 11 | 11.8 | 8.5 |
| | Volume Resistivity | 9.6 | 8.8 | 9.2 | 7.8 |
| Transfer Roller Opposed Roller 214 | Material | Polyurethane | Polyurethane | Polyurethane | Polyurethane |
| | Resistance | 7.5 | 7.5 | 7.5 | 7.5 |
| | Bias | 35 [μA] | 35 [μA] | 35 [μA] | 35 [μA] |
| Secondary Transfer Roller 304 | Material | NBR | NBR | NBR | NBR |
| | Resistance | 5.5 | 5.5 | 5.5 | 5.5 |
| | Bias | Grounded | Grounded | Grounded | Grounded |
| Vibration Generating Unit 400 | Frequency | — | 39.8 [kHz] | 39.8 [kHz] | 39.8 [kHz] |
| | Output | — | 10 [W] | 10 [W] | 10 [W] |
| Embossed Paper | | 1 | 1.5 | 3 | 4 |
| Two-color Toner Scattering | | 4 | 4 | 4 | 2 |
| Uniform Transferability | | 5 | 5 | 5 | 5 |
| Others | | | | 7.5 [kV] Insufficient Power Source | |

In Table 2, "CC" represents Comparative Condition.

In Table 1, the test results of Example Condition 1 were obtained by using a test apparatus having the configuration of Exemplary Embodiment 1, the test results of Example Conditions 2 to 4 were obtained by using a test apparatus having the configuration of Exemplary Embodiment 2, and the test results of Comparative Example 5 were obtained by using a test apparatus having Modified Exemplary Embodiment 2.

In Table 2, the test results of Comparative Condition 1 were obtained by using a test apparatus having a related-art configuration, the test results of Comparative Condition 1 were obtained by using a test apparatus having a configuration explained using FIG. 7, and Comparative Conditions 3 and 4 were obtained by using a test apparatus having a configuration of Modified Exemplary Embodiment 1.

The inventor of the present invention performed the measurement method of volume resistivity of the intermediate transfer belt 20 and the transfer sheet conveyance belt 300 according to the test of the present invention. The measurement conditions are as follows;

Resistance Measuring Instrument: HIRESTA-UP (manufactured by MITSUBISHI CHEMICAL CORPORATION);
Ring Probe: URS probe;
Object Supporting Member: REGI TABLE, with conductive rubber having thickness of 1 mm;
Measurement Voltage: 100V;
Measurement Time: 10 second point; and
Pressure Force: 2 kgf.

The inventor of the present invention also performed the measurement method of surface resistivity of the intermediate transfer belt 20 and the transfer sheet conveyance belt 300 according to the test of the present invention. The measurement conditions are as follows;

Resistance Measuring Instrument: HIRESTA-UP (manufactured by MITSUBISHI CHEMICAL CORPORATION);
Ring Probe: URS probe;
Object Supporting Member: REGI TABLE, insulated;
Measurement Voltage: 500V;
Measurement Time: 10 second point; and
Pressure Force: 2 kgf.

In this exemplary embodiment, volume resistivity and surface resistivity of the belt members shown in Tables 1 and 2 are described in common logarithm values;

Volume Resistivity: log (Ω·cm); and
Surface Resistivity: log (Ω/square).

Figure 6:
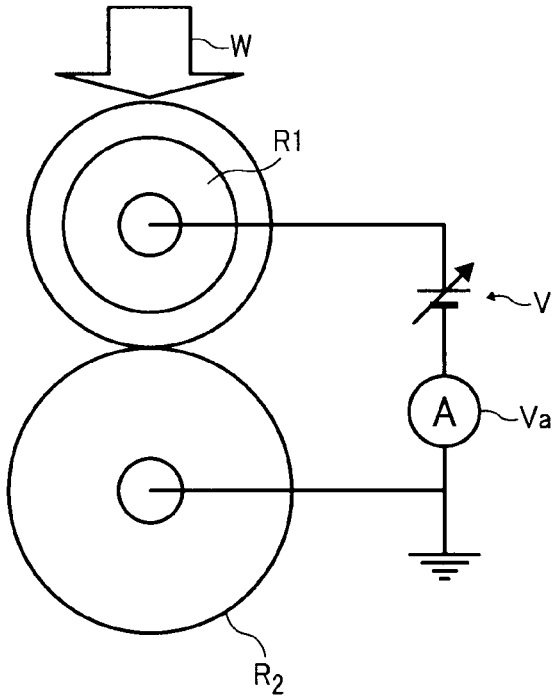
FIG. 6 is a schematic view illustrating an instrument used for measuring the combined volume resistivity of a roller member.

FIG. 6 is a schematic view illustrating a measurement instrument for explaining a method of measuring the volume resistivity of a roller member used in the test.

The measurement instrument shown in FIG. 6 includes an opposing metal roller R2, a high voltage power source V, and an ammeter Va.

The opposing metal roller R2 is a stainless roller having a diameter ϕ of 30 mm. A sample roller R1 for measuring the volume resistivity is pressed at a force W of 50 gf/cm against the opposing metal roller R2. The opposing metal roller R2 is fixed by a bearing. A given voltage is applied by the high voltage power source (610D, manufactured by TREK JAPAN CO., LTD.) to a place between the opposing metal roller R2 and a shaft of the sample roller R1 to measure the current flowing the opposing metal roller and the sample roller using the ammeter Va (6514, manufactured by KEITHLEY INSTRUMENTS INC.).

The high voltage power source and the ammeter Va are not limited to the above models.

It is possible to calculate the resistivity based on the given voltage and the measured current value manually. However, it is more preferable to automatically input, store, and process the measured data via a personal computer.

The resistivity was measured under an environment condition at a temperature of 22 degrees Celsius and at a relative humidity of 55% RH. When the environment condition is different, the value is corrected using absolute humidity.

If the sample roller R1 includes an ion conductive roller, the resistance value of the ion conductive roller significantly depends on the temperature and humidity conditions, and therefore the measurement after adjustment of humidity is performed for 5 hours and more.

In this exemplary embodiment, the resistance value of the roller members shown in Tables 1 and 2 are also described in common logarithm values;

Roller Resistance: LogR ("R" is based on measured resistance.).

Next, a description is given of evaluation of images in the test.

In this test, the evaluation of images based on transferability to paper sheets having convex and concave portions to confirm improvement of transferability.

As for the transfer material, an A4-sized sheet of paper, SAZANAMI, manufactured by Ricoh, was used.

SAZANAMI is an embossed Japanese paper having convex and concave portions and has poor transferability in the concave portions, and more particularly, color on a two-color solid image such as an RGB image becomes uneven easily according to the concave portions. Generally, when a multi-layer toner image is formed by forming a two-color toner image such as an RGB image on the intermediate transfer belt 20, the toner image on the upper layer thereof is transferred onto the transfer sheet S. However, it is difficult to transfer the toner image on the lower layer, and therefore the transferred toner image may be uneven because the toner image has some parts having a single-layer toner image and the other parts having two-layered or composite color toner image.

The transferability of toner image onto the SAZANAMI paper having the concave portions was evaluated and the evaluation was ranked.

The following shows the evaluation standard of transferability:

Rank 5 represents a highest rank indicating good image performance, that is, both the upper layer and lower layer of the toner image are transferred successfully and the toner image is reproduced in a same tone as the original document;

Rank 4 represents a threshold or border of acceptance and indicates that transfer of toner image on the upper layer is degraded and the color of toner on the lower layer is slightly observable;

Rank 3 indicates that the toner image on the upper layer is slightly transferred and the color of toner image on the lower layer is significantly observable;

Rank 2 indicates that the toner image on the upper layer is not transferred and only the color of toner image on the lower layer is transferred; and Rank 1 indicates that the toner images on the upper and lower layer are not transferred and the background of the transfer sheet is observable on the concaved portions thereof.

Toner scattering on a transferred image was evaluated into ranks with RGB text images. The RGB text images were output and enlarged with a 20× magnification loupe to examine toner scattering around the texts. The following ranks describe evaluation standard of toner scattering of two-color text:

Rank 5 represents a highest rank indicating good image performance, that is, toner scattering is hardly found around the texts enlarged by the 20× magnification loupe;

Rank 4 represents a threshold or border of acceptance and indicates that only a small amount of toner scattering is found around the texts enlarged by the 20× magnification loupe but cannot be observed visually;

Rank 3 indicates that the color of toner scattering can slightly be observed around the texts visually;

Rank 2 indicates that the color of toner scattering can be observed around the texts visually; and Rank 1 indicates that the range of toner scattering is wider and the color of toner scattering can be observed visually.

Uniform transfer ability represents transferability of a dot pattern image. If the transferability is poor, toner scattering occurs, which can result in high density of a toner image by visual check.

The following ranks describe evaluation standard of the uniform transfer ability:

Rank 5 represents a highest rank indicating good image performance, that is, a single color halftone solid image is transferred on a recording medium uniformly and smoothly;

Rank 4 indicates that a single color halftone solid image is transferred on a recording medium uniformly but slight density irregularity or a slight difference in grayscale values is observed;

Rank 3 indicates that a single color halftone solid image has density irregularity or a difference in grayscale values;

Rank 2 indicates that a halftone solid image has clear density irregularity or a clear difference in grayscale values; and Rank 1 indicates that over the half or greater area of a halftone solid image is covered by deep gray density.

Next, a detailed description is given of units and components of the secondary transfer mechanism 30 of the image forming apparatus 500 used in the test.

In the image forming apparatus 500 used in the test, the surface of the intermediate transfer belt 20 moves at a speed of 285 millimeters per second [mm/sec]. The transfer area entrance roller 203 is a metallic roller that is grounded. The transfer area exit roller 204 is a roller having a metal shaft covered by an NBR material. The resistance is 6.8 in logarithmic expression obtained by applying 1,000 volts [V] for 10 seconds using the measurement method explained with FIG. 6. The intermediate transfer belt 20 includes a polyimide resin having a thickness of 80 micrometers [μm], a surface resistivity of 10.5, and a volume resistivity of 8.8.

The transfer sheet conveyance belt 300 includes the same resistance as that of the intermediate transfer belt 20. The first conveyance belt extension roller 301 that extends the transfer sheet conveyance belt 300 is a metallic roller that is grounded. The second conveyance belt extension roller 302 that extends the transfer sheet conveyance belt 300 is an insulating roller that is grounded.

The secondary transfer roller 304 that is disposed facing the secondary transfer bias applying member (e.g., the transfer area exit roller 204 and the voltage applying brush 205) is a roller having a metallic roller covered by an elastic layer formed by urethane foam. The resistance of the secondary transfer roller 304 is 6.5 in logarithmic expression.

Further, the conductive brush fibers of the voltage applying brush 205 include carbon-containing acrylic fibers.

The level of vibration applied by the ultrasonic vibration generating unit 400 is at a frequency of 39.8 kilohertz [kHz]

and an output of 10 watts [W]. For controlling the secondary transfer bias, the constant-current control was performed with 35 micro amps [μA] for the voltage applying brush 205 that is an upstream secondary transfer bias applying member and with 30 micro amps [μA] for the transfer area exit roller 204 that is a downstream secondary transfer bias applying member.

In the image forming apparatus 500 used in the test, the upper limit of capacity of the secondary transfer power source for generating the secondary transfer bias is set to 7 kilovolts [kV] according to easy occurrence of leakage to an adjacent member disposed in a vicinity of the secondary image transfer nip due to its duration.

In Example Conditions 1 through 4, a blue solid image was used for evaluation. The image to which the ultrasonic waves were applied was transferred uniformly to the concave portions. The upper secondary transfer power source V1 applies a voltage of 3.2 kilovolts [kV] to the voltage applying brush 205 that is the upstream secondary transfer bias applying member, and the lower secondary transfer power source V2 applies a voltage of 3.4 kilovolts [kV] to the transfer area exit roller 204 that is the downstream secondary transfer bias applying member. Accordingly, both voltages were below the upper limit voltage, 7 kilovolts [kV], of capacity of the power source.

[Comparative Example 1]

Next, a description is given of a schematic configuration of an image forming apparatus 500A used as an apparatus for Comparative Example 1, which is used in Comparative Condition 2 in Table 2, referring to FIG. 7.

As shown in FIG. 7, the image forming apparatus 500A includes a secondary transfer mechanism 30A that includes an ultrasonic vibration generating unit 400A. Elements or components of the image forming apparatus 500A in FIG. 7 may be denoted by the same reference numerals as those of the image forming apparatus 500 according to an exemplary embodiment of the present invention and the descriptions thereof are omitted or summarized.

The ultrasonic vibration generating unit 400A that includes the vibration imparting part 407 to contact at a position P on the intermediate transfer belt 20 to apply ultrasonic vibrations to the intermediate transfer belt 20 the inner surface of the intermediate transfer belt 20 between the transfer roller opposed roller 214 and the upstream extension roller 213 that is disposed upstream from the transfer roller opposed roller 214 in the direction A that is a direction of rotation of the intermediate transfer belt 20.

In this configuration shown in FIG. 7, the image forming apparatus 500A further includes a transfer power source V0 that applies a transfer bias voltage having the same polarity as toner of the toner image T to the transfer roller opposed roller 214. Between the transfer roller opposed roller 214 and the secondary transfer roller 304 that is electrically grounded, a secondary image transfer nip N' is formed.

The inventor has found that this configuration of Comparative Example 1 does not improve the toner image transferability significantly compared to a configuration without the ultrasonic vibration generator. The detailed reason of this conclusion is described below.

In the configuration of the image forming apparatus 500A as shown in FIG. 7, the transfer roller opposed roller 214 serving as a transfer electric generating member and the secondary transfer roller 304 serving as a transfer electric generating member on the side of the transfer sheet S form the secondary image transfer nip N' by contacting to each other at the same position in the direction of rotation of the surface of the intermediate transfer belt 20. Therefore, the secondary transfer electric field formed due to a difference in electric potential between the transfer roller opposed roller 214 and the secondary transfer roller 304 is generated only within a narrow nip width of the secondary image transfer nip N'. Therefore, in the configuration of FIG. 7, even if ultrasonic vibrations are applied at a position where the vibration imparting part 407 contacts the intermediate transfer belt 20, the secondary transfer electric field does not obtain a sufficient effect of the vibration, and the secondary image transfer nip N' where the secondary transfer electric field is formed is not affected by the vibrations sufficiently. Consequently, it is contemplated that the configuration of Comparative Example 1 shown in FIG. 7 does not improve the toner image transferability remarkably, compared to the configuration without employing the ultrasonic vibration generator.

In the configuration of Comparative Example 1 illustrated in FIG. 7, the ultrasonic vibration generating unit 400A may need to apply ultrasonic vibrations to the intermediate transfer belt 20 away from the secondary image transfer nip N'. Since the secondary transfer electric field is generated in the secondary image transfer nip N' formed between two rollers (e.g., the secondary transfer roller 304 and the transfer roller opposed roller 214), even if the vibration imparting part 407 of the ultrasonic vibration generating unit 400A contacts the position P that is away from the secondary image transfer nip N' to apply the ultrasonic vibrations to the intermediate transfer belt 20, the ultrasonic vibration applied at the position P may not work effectively for improvement of the toner image transferability using the secondary transfer electric field. If the ultrasonic vibrations are applied to such a place on the intermediate transfer belt 20 where the secondary transfer electric field is hardly effective to the toner image transferability, the toner image T on the intermediate transfer belt 20 fixes to increase the adhesion force to the intermediate transfer belt 20, thereby preventing enhancement of toner image transferability to the transfer sheet S.

By contrast, in the present invention, the transfer area exit roller 204 contacts the inner face of the intermediate transfer belt 20 in a direction of rotation of the intermediate transfer belt 20 at a position different from where the secondary transfer roller 304 contacts the intermediate transfer belt 20. Therefore, even though the magnitude of the secondary transfer electric field may vary depending on the resistance/resistivity of the intermediate transfer belt 20 and the configuration of the secondary transfer member (for example, a belt-type member such as the transfer sheet conveyance belt 300 or a roller-type member such as the secondary transfer roller 304), a secondary transfer electric field is formed over the entire area from where the transfer area exit roller 204 contacts the intermediate transfer belt 20 to where the secondary transfer roller 304 contacts the intermediate transfer belt 20.

Further, the vibration imparting part 407 of the ultrasonic vibration generating unit 400 contacts the intermediate transfer belt 20 in the area formed between the transfer area exit roller 204 and the contact area of the secondary transfer roller 304 with respect to the intermediate transfer belt 20. Therefore, ultrasonic vibrations can be applied to the intermediate transfer belt 20 within an area where the secondary transfer electric field is generated.

Further, in the present invention, the transfer area exit roller 204 contacts the inner face of the image conveyance belt extended surface portion 20*a* of the intermediate transfer belt 20, and the secondary transfer roller 304 contacts the image conveyance belt extended surface portion 20*a* directly or via the intermediate transfer belt 20.

Therefore, the vibration imparting part 407 of the ultrasonic vibration generating unit 400 that contacts the intermediate transfer belt 20 between the transfer area exit roller 204 and the secondary transfer roller 304 also contacts the image conveyance belt extended surface portion 20*a* of the intermediate transfer belt 20.

Thus, with the configuration in which the vibration imparting part 407 of the ultrasonic vibration generating unit 400 contacts the image conveyance belt extended surface portion 20*a* of the intermediate transfer belt 20, the present invention can apply ultrasonic vibrations to the position where the ultrasonic vibrations can be transmitted to the intermediate transfer belt 20 that serves as the toner image carrying member easily, compared to a related-art configuration in which the vibration is applied to a toner image carrying belt at a position where two rollers are disposed facing and pressed against each other.

[Comparative Example 2]

Figure 8:
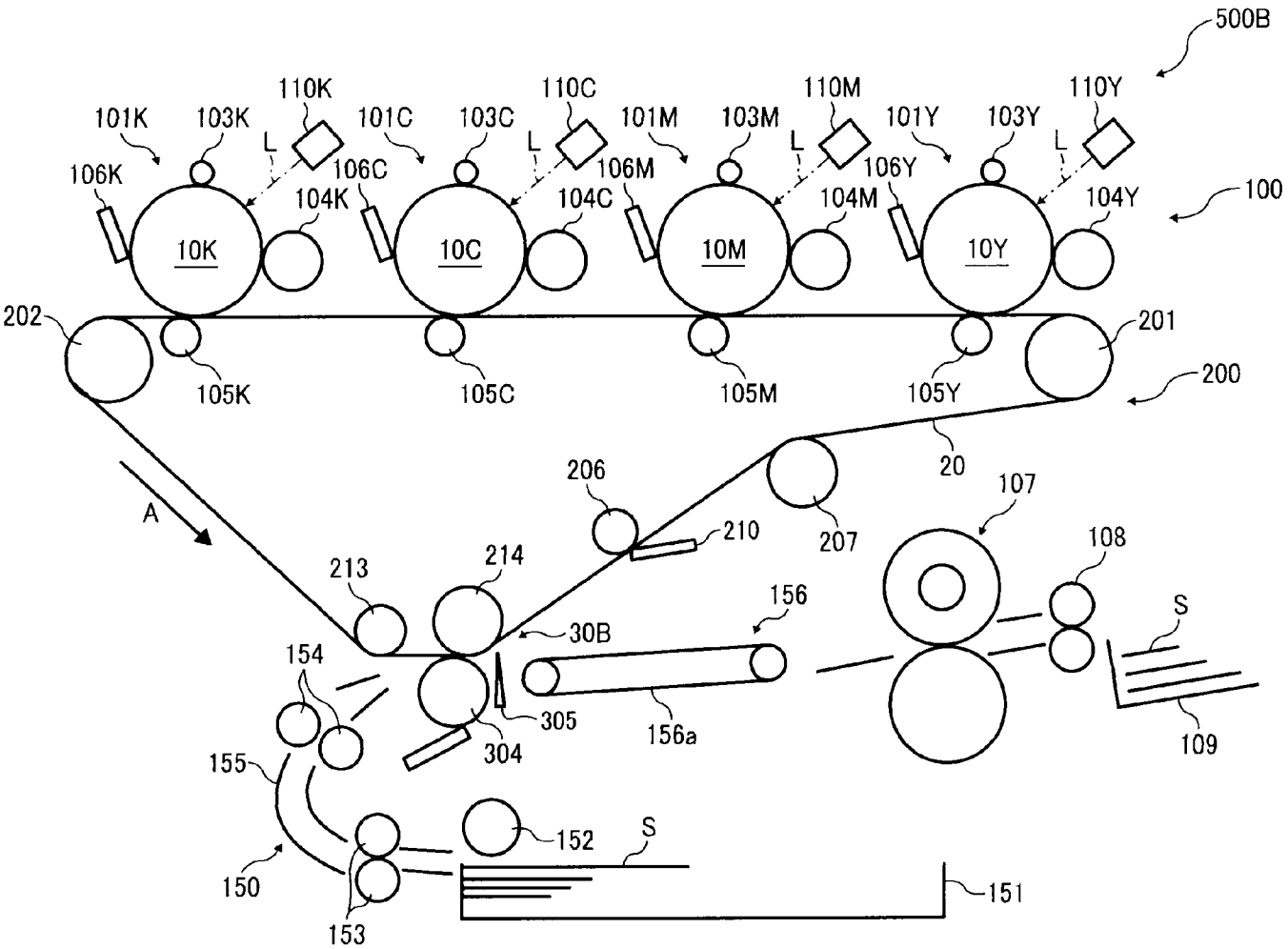
FIG. 8 is an enlarged view of an image forming apparatus for Comparative Example 2.

Next, a description is given of a configuration of Comparative Example 2 used in Comparative Condition 1 in Table 2, referring to FIGS. 8 and 9.

FIG. 8 is a schematic configuration of an image forming apparatus 500B as Comparative Example 2, and FIG. 9 is an enlarged view of a secondary transfer mechanism 30B of the image forming apparatus 500B.

Elements or components of the secondary transfer mechanism 30B according to Comparative Embodiment 2 may be denoted by the same reference numerals as those of the secondary transfer mechanism 30A according to Comparative Embodiment 1 and the descriptions thereof are omitted or summarized.

As shown in FIGS. 8 and 9, the configuration of Comparative Embodiment 2 is similar to the configuration of Comparative Embodiment 1 shown in FIG. 7. Except that the configuration of Comparative Embodiment 2 does not include the ultrasonic vibration generating unit 400A and the secondary transfer roller 304 contacts the transfer roller opposed roller 214 via the intermediate transfer belt 20 but does not face the transfer roller opposed roller 214, as shown in the transfer nip N' of FIG. 9. That is, the secondary transfer roller 304 contacts the intermediate transfer belt 20 at a slightly upstream position from the position where the transfer roller opposed roller 214 contacts the opposite side of the intermediate transfer belt 20 in the direction of rotation of the surface of the intermediate transfer belt 20. By displacing the contact position of the secondary transfer roller 304 to the intermediate transfer belt 20 from the contact position of the transfer roller opposed roller 214 to the intermediate transfer belt 20, a pressing force to press the transfer sheet S against the surface of the intermediate transfer belt 20 is exerted, thereby increasing adhesion between the intermediate transfer belt 20 and the transfer sheet S.

However, toner particles become cohesive due to a nip pressure between the transfer roller opposed roller 214 and the secondary transfer roller 304, which can result in defects in transfer such as hollow defects of texts and insufficient transfer with respect to less smooth papers and embossed papers.

Even if the secondary transfer roller 304 employs either a secondary transfer system in which an image is transferred onto a transfer sheet directly or a transfer conveyance belt system in which an image is transferred onto a transfer sheet via a transfer conveyance belt, it is preferable that a secondary transfer bias applying member and the transfer sheet do not directly contact when a secondary transfer bias is applied.

Further, if the humidity of a transfer sheet is controlled and the resistance is decreased, the electric current flows into registration rollers and metallic guide members to cause void. Therefore, the secondary transfer bias is preferably applied from the back side of an intermediate transfer belt. However, this application method is not to be limited.

The configurations of Exemplary Embodiments 1 and 2 employ the conductive voltage applying brush 205 as one of the secondary transfer bias applying members, and the vibration imparting part 407 is disposed on the intermediate transfer belt 20 between the voltage applying brush 205 and the secondary transfer roller 304. If the vibration imparting part 407 is disposed between the contact position of the transfer area exit roller 204 and the contact position of the secondary transfer roller 304, the vibration imparting part 407 may need to be located at the left side of the left edge of the transfer area exit roller 204 in FIG. 2 and the secondary transfer roller 304 may need to be located on the left side of the transfer area exit roller 204. Under this condition, the contact position of the transfer area exit roller 204 and the contact position of the secondary transfer roller 304 may need to be separated. The more the distance between the secondary transfer bias applying member (e.g., the transfer area exit roller 204) and the transfer electric generating member on the transfer sheet side (e.g., the secondary transfer roller 304) disposed sandwiching the vibration imparting part 407 therebetween increases, the greater the resistance value when the electric current flows through the intermediate transfer belt 20 becomes, and therefore the difference in electric potential may need to be increased and the resistivity of the belt may need to be decreased.

The configurations of Exemplary Embodiments 1 and 2 provide the vibration imparting part 407 between the voltage applying brush 205 and the secondary transfer roller 304, and therefore the contact position of the voltage applying brush 205 to the intermediate transfer belt 20 and the contact position of the vibration imparting part 407 to the intermediate transfer belt 20 can be arranged closer. Further, the distance between the contact position of the voltage applying brush 205 to the intermediate transfer belt 20 and the contact position of the secondary transfer roller 304 to the intermediate transfer belt 20 can be smaller. Thereby, the distance for electric current to flow between the voltage applying brush 205 and the secondary transfer roller 304 with respect to the intermediate transfer belt 20 can be reduced and the bad influence of resistance of the intermediate transfer belt 20 can be suppressed.

The configurations of Exemplary Embodiments 1 and 2 provide the vibration imparting part 407 between the voltage applying brush 205 and the secondary transfer roller 304, and therefore the contact position of the voltage applying brush 205 to the intermediate transfer belt 20 and the contact position of the vibration imparting part 407 to the intermediate transfer belt 20 can be arranged closer. Further, the distance between the contact position of the voltage applying brush 205 to the intermediate transfer belt 20 and the contact position of the secondary transfer roller 304 to the intermediate transfer belt 20 can be smaller. Thereby, the distance for electric current to flow between the voltage applying brush 205 and the secondary transfer roller 304 on the intermediate transfer belt 20 can be reduced and the bad influence of resistance of the intermediate transfer belt 20 can be suppressed.

Further, the transfer area exit roller 204 is provides as a downstream secondary transfer bias applying member. However, it is not necessary to provide the vibration imparting part 407 between the contact position of the transfer area exit roller 204 and the contact position of the secondary transfer roller 304, thereby reducing the distance between these contact positions.

In the configurations of Example Conditions 1 through 4, which correspond to the configurations illustrated in FIGS. 2 and 3, the distance between the contact position of the voltage applying brush 205 serving as a transfer electric generating member on the photoconductor side and the contact position of the secondary transfer roller 304 serving as a transfer electric generating member on the transfer sheet side on the intermediate transfer belt 20 was 5 millimeters [mm]. Also, the distance between the contact position of the transfer area exit roller 204 serving as a transfer electric generating member on the photoconductor side and the contact position of the secondary transfer roller 304 on the intermediate transfer belt 20 was 15 millimeters [mm].

By contrast, in the configuration of Comparative Conditions 3 and 4, which correspond to the configuration illustrated in FIG. 4, the distance between the contact position of the transfer roller opposed roller 214 and the contact position of the secondary transfer roller 304 on the intermediate transfer belt 20 was 20 millimeters [mm]. Further, in the configuration of Comparative Condition 5, which correspond to the configuration illustrated in FIG. 5, the distance between the contact position of the transfer area exit roller 204 and the contact position of the secondary transfer roller 304 on the intermediate transfer belt 20 was 20 millimeters [mm].

As described above, the distance from the position of the transfer roller opposed roller 214 to contact the intermediate transfer belt 20 to the position of the secondary transfer roller 304 to contact the intermediate transfer belt 20 in the configuration shown in FIG. 4 is longer than the distance from the position of the voltage applying brush 205 to contact the intermediate transfer belt 20 to the position of secondary transfer roller 304 to contact the intermediate transfer belt 20 in the configurations shown in FIGS. 2 and 3. Therefore, as shown in Comparative Condition 3, if the secondary transfer bias of 35 micro amps [μA] having the constant current control is applied without setting the setting of the surface resistivity of the intermediate transfer belt 20 to a low value, the transferability has enhanced and no image characteristics are adversely affected. However, the voltage of 7.5 kilovolts [kV] of the secondary transfer bias is required, which exceeds the upper limit of the power source capacity, 7 kilovolts [kV], and therefore it is difficult to employ the configuration for practical use.

In addition, to maintain the voltage of the secondary transfer bias at 7.0 kilovolts [kV] or below, as shown in Comparative Condition 4, the surface resistivity of the intermediate transfer belt 20 is decreased, thereby enhancing the transferability but degrading toner scattering of two-color texts among other image characteristics.

Further, the distance between the contact position of the transfer area exit roller 204 to the intermediate transfer belt 20 and the contact position of the secondary transfer roller 304 to the intermediate transfer belt 20 is longer in the configuration illustrated in FIG. 5 than in the configurations illustrated in FIGS. 2 and 3. If electric current is difficult to flow smoothly to the intermediate transfer belt 20, the voltage of the secondary transfer bias can exceed the limit of power source capacity or the resistivity of the intermediate transfer belt 20 can be decreased. To prevent these disadvantages, the surface resistivity of the transfer sheet conveyance belt 300 is set low. Thus, when only the surface resistivity of the transfer sheet conveyance belt 300 without decreasing the surface resistivity of the intermediate transfer belt 20, electric current flows over the surface of the transfer sheet conveyance belt 300 to the position opposite the transfer area exit roller 204, as indicated by arrow E in FIG. 5 and the electric current flows to the transfer area exit roller 204 via the transfer sheet S, the toner layer T, and the intermediate transfer belt 20. Therefore, the magnitude of the secondary transfer electric field increases at the opposite position of the transfer sheet conveyance belt 300 and the transfer area exit roller 204 and the magnitude of the secondary transfer electric field decreases at the position where the vibration imparting part 407 contacts the intermediate transfer belt 20. Therefore, the configuration of Comparative Condition 5 is less effective in enhancing transferability by application of ultrasonic vibrations, compared to the configurations of Exemplary Embodiments 1 and 2.

In an exemplary embodiment, one of two secondary transfer bias applying members is a voltage applying brush and the other is a roller-shaped member. Alternatively, both of the two secondary transfer bias applying members can be a voltage applying brush. However, if a secondary transfer bias applying member different from the extension roller at the trailing edge of the image conveyance belt extended surface portion is provided, a voltage applying brush may need to be disposed upstream by half or more of the radius of the extension roller at the trailing edge from the trailing edge of the extended surface portion, and the contact position of the transfer sheet side transfer electric generating member may need to be disposed further upstream from the voltage applying brush, thereby increasing the size of the apparatus.

In the configuration in an exemplary embodiment of the present invention, a toner image carrying belt corresponds to the intermediate transfer belt 20 and an image receiving member to be transferred corresponds to the transfer sheet S. However, the combination of a toner image carrying belt that forms a transfer part to apply ultrasonic vibrations to the transfer nip is not limited thereto. For example, a configuration to transfer an image from a belt-shaped image carrier to an image forming member or to a transfer sheet is applicable to the present invention.

As described above, the image forming apparatus 500 according to an exemplary embodiment of the present invention includes the intermediate transfer belt 20, multiple extension rollers 201, 202, 203, 204, 206, and 207, the transfer sheet conveyance belt 300, and the ultrasonic vibration generating unit 400.

The intermediate transfer belt 20, which serves as a toner image carrying belt or an endless transfer belt, is wound around the multiple extension rollers 201, 202, 203, 204, 206, and 207 and rotates in an endless manner while carrying a toner image on a surface thereof.

The transfer sheet conveyance belt 300, which serves as a secondary transfer unit and an endless transfer belt, is disposed facing the intermediate transfer belt 20. The surface of the transfer sheet conveyance belt 300 is rotated with the intermediate transfer belt 20 in an endless manner in a direction of rotation of the intermediate transfer belt 20. The transfer sheet conveyance belt 300 forms the secondary image transfer nip for transferring a toner image on the intermediate transfer belt 20 onto the surface of the transfer sheet S serving as a recording medium at an opposed portion of the intermediate transfer belt 20.

The ultrasonic vibration generating unit 400 serves as an ultrasonic vibration generator is disposed inboard of the intermediate transfer belt 20, and includes the vibration imparting part 407 that contacts the inner face of the intermediate transfer belt 20. The ultrasonic vibration generating unit 400 imparts ultrasonic vibrations from the vibration imparting part 407 to the intermediate transfer belt 20.

With this configuration, the image forming apparatus 500 forms the secondary transfer electric field in the secondary image transfer nip by the action of the difference in electric potential between the transfer area exit roller 204 and the voltage applying brush 205, both of which are photoconductor transfer electric generating members, disposed on the inner face side of the intermediate transfer belt 20 and the secondary transfer roller 304 that is also a secondary transfer member and a transfer electric generating member disposed on the inner face side of the transfer sheet conveyance belt 300.

The secondary image transfer nip formed in the image forming apparatus 500 is formed between one of the extended surface portions (e.g., the image conveyance belt extended surface portion 20*a*) of the intermediate transfer belt 20 and the contact position of the surface of the transfer sheet conveyance belt 300.

Both the transfer area exit roller 204 and the voltage applying brush 205 contact the inner face side of the image conveyance belt extended surface portion 20*a* of the intermediate transfer belt 20. The image conveyance belt extended surface portion 20*a* serves as the transfer nip extended surface portion on the photoconductor side of the intermediate transfer belt 20. In the secondary image transfer nip, the secondary transfer roller 304 contacts the image conveyance belt extended surface portion 20*a* via the transfer sheet conveyance belt 300 serving as the endless transfer belt and the secondary transfer unit. The contact position of the secondary transfer roller 304 to the intermediate transfer belt 20 is displaced from the contact positions of the transfer area exit roller 204 and the voltage applying brush 205 to the intermediate transfer belt 20 in the direction of rotation of the intermediate transfer belt 20. The vibration imparting part 407 of the ultrasonic vibration generating unit 400 is disposed between the contact position of the voltage applying brush 205, which serves as one of the two photoconductor transfer electric generating members, to the intermediate transfer belt 20 and the contact position of the secondary transfer roller 304 to the intermediate transfer belt 20.

With this configuration, the image forming apparatus 500 can impart the ultrasonic vibrations to the intermediate transfer belt 20, within the area on the intermediate transfer belt 20 where the secondary transfer electric field is formed by the action of the difference in electric potential between the voltage applying brush 205 and the secondary transfer roller 304.

Further, the vibration imparting part 407 contacts the intermediate transfer belt 20 at a different position from the intermediate transfer belt 20 is extended by the extension rollers, the ultrasonic vibrations can be transmitted easily, compared to the configuration in which ultrasonic vibrations is imparted to the intermediate transfer belt 20 where the rollers disposed facing each other and contact at the same position on the intermediate transfer belt 20.

Accordingly, the image forming apparatus 500 having this configuration can transmit the ultrasonic vibrations to the intermediate transfer belt 20 easily. In addition, the vibration imparting part 407 of the ultrasonic vibration generating unit 400 contacts in the area where the secondary transfer electric field is generated on the intermediate transfer belt 20, thereby enhancing the transferability assuredly by imparting the ultrasonic vibrations.

Further, in the image forming apparatus 500 according to an exemplary embodiment of the present invention, the secondary transfer member or the transfer sheet conveyance member is the transfer sheet conveyance belt 300 that is wound around the multiple extension rollers. The secondary image transfer nip is formed between one of the extended surface portions of the transfer sheet conveyance belt 300 as a belt-shaped secondary transfer member and the image conveyance belt extended surface portion 20*a*, and the secondary transfer roller 304 serving as the transfer sheet side transfer electric generating member contacts the inner face side of the transfer sheet conveyance belt 300 in the secondary image transfer nip. By forming the secondary image transfer nip where the belt members contact each other, the nip width of the secondary image transfer nip can increase assuredly.

Further, in the image forming apparatus 500 according to an exemplary embodiment of the present invention, the first conveyance belt extension roller 301 and the second conveyance belt extension roller 302, both of which serve as extension rollers to extend the transfer sheet conveyance belt 300 are rotated with the rotation of the transfer sheet conveyance belt 300. Specifically, in the configuration of Exemplary Embodiment 2, the first conveyance belt extension roller 301 is electrically grounded and the inlet roller power source V3 applies a bias voltage having a polarity opposite that of the toner to the transfer area entrance roller 203. Thus, an electric field is formed in a vicinity of the entrance of the secondary image transfer nip to attract the toner image T carried on the surface of the intermediate transfer belt 20 and the transfer sheet conveyance belt 300 to the intermediate transfer belt 20. If the electric field to attract the toner to the transfer sheet conveyance belt 300 is formed between the intermediate transfer belt 20 and the transfer sheet conveyance belt 300 at the entrance of the secondary image transfer nip, it is likely that toner scattering due to a transfer image operation across the gap between the intermediate transfer belt 20 and the transfer sheet conveyance belt 300 occurs to scatter toner on the transfer member, etc.

Further, since no electrostatic attraction force exists between a position upstream from the secondary transfer electric field formed by the secondary transfer bias on the intermediate transfer belt 20 and the transfer sheet conveyance belt 300, the adhesion between the intermediate transfer belt 20 and the transfer sheet conveyance belt 300 is low. Therefore, if the transfer sheet S is conveyed to a position intermediate between these belts having a low adhesion therebetween, the transfer sheet S can be displaced, which is susceptible to slur of the reproduced toner image Further, in the configuration in which one of the extension rollers around which the transfer sheet conveyance belt 300 is extended and is a driven roller and the intermediate transfer belt 20 and the transfer sheet conveyance belt 300 are rotated by respective drive rollers disposed inside these belts, the difference in rotation speed of the surfaces between two belts in the secondary image transfer nip cannot be eliminated completely. If the transfer sheet conveyance belt 300 closely contacts the intermediate transfer belt 20 electrostatically while there is a difference in rotation speed of the surfaces of the two belt members, slur of reproduced toner images can be caused easily due to the difference in rotation speed between the surfaces of these belt members.

In the image forming apparatus 500 according to Exemplary Embodiment 2 of the present invention, a bias voltage having a polarity opposite the toner image T on the surface of the intermediate transfer belt 20 is applied to the transfer area entrance roller 203 that forms the entrance part of the secondary image transfer nip formed between the intermediate transfer belt 20 and the transfer sheet conveyance belt 300. This action can prevent toner scattering in the gap upstream from the entrance part of the secondary image transfer nip.

Further, the bias voltage is applied to the transfer area entrance roller 203, the transfer sheet conveyance belt 300 is electrostatically attracted at the entrance part of the secondary image transfer nip to the intermediate transfer belt 20 to closely contact the transfer sheet conveyance belt 300 to the intermediate transfer belt 20. However, the transfer sheet conveyance belt 300 that does not include a drive roller is rotated with the intermediate transfer belt 20 by adhering closely thereto. This action can prevent a difference in rotation speed of each surface between the transfer sheet conveyance belt 300 and the intermediate transfer belt 20. Accordingly, slur of the transfer sheet S due to the difference in rotation speed of each surface of the transfer sheet conveyance belt 300 and the intermediate transfer belt 20 can be prevented, thereby further preventing the slur of reproduced toner images.

Thus, the image forming apparatus 500 according to Exemplary Embodiment 2 of the present invention employs the transfer sheet conveyance belt 300 that is rotated with the intermediate transfer belt 20, and therefore can prevent occurrence of lateral or transversal band-shaped density nonuniformity such as banding caused by a difference in speed between the intermediate transfer belt 20 and the transfer sheet conveyance belt 300 or in thickness of paper sheets.

Further, a bias voltage having a polarity opposite the toner image T on the surface of the intermediate transfer belt 20 is applied to the transfer area entrance roller 203 that forms the entrance part of the secondary image transfer nip. This action can prevent toner scattering in the gap upstream from the entrance part of the secondary image transfer nip.

Further, the ultrasonic vibrations are applied by increasing the adhesion force between the intermediate transfer belt 20 and the transfer sheet S, so that the toner scattering caused by the gap across the intermediate transfer belt 20 and the transfer sheet S can be prevented.

Further, in the image forming apparatus 500 according to Exemplary Embodiment 2 of the present invention, the inlet roller power source V3 applies a bias voltage to the transfer area entrance roller 203 that serves as an extension roller extending the intermediate transfer belt 20 at the upstream end part of the image conveyance belt extended surface portion and the first conveyance belt extension roller 301 is electrically grounded. Under this configuration, a difference in electric potential between the transfer area entrance roller 203 and the first conveyance belt extension roller 301 attracts the toner image T carried on the intermediate transfer belt 20 and the transfer sheet conveyance belt 300 to the intermediate transfer belt 20.

Thus, one of the transfer area entrance roller 203 and the first conveyance belt extension roller 301 is applied with the bias voltage and the other is located in a vicinity of the entrance of the secondary image transfer nip to attract the toner to the intermediate transfer belt 20. Accordingly, to prevent toner scattering near the entrance of the secondary image transfer nip and slur of the transfer sheet S in the secondary image transfer nip, an effective electric field can be provided without additionally providing a particular bias applying member.

Further, the image forming apparatus 500 according to an exemplary embodiment of the present invention includes two photoconductor transfer electric generating members, which are the voltage applying brush 205 and the transfer area exit roller 204. In this configuration, the vibration imparting part 407 of the ultrasonic vibration generating unit 400 contacts the intermediate transfer belt 20 between the position where the voltage applying brush 205 contacts the intermediate transfer belt 20 and the position where the transfer area exit roller 204 contacts the intermediate transfer belt 20. Thus, this configuration includes at least two photoconductor transfer electric generating members, and the vibration imparting part 407 contacts the intermediate transfer belt 20 therebetween. By so doing, a wider area for forming the secondary transfer electric field can be obtained and a longer period of time for the image transfer operation can be assured. Further, the application of the ultrasonic vibrations to the intermediate transfer belt 20 in the area where the transfer electric field is formed can reduce the adhesion force of toner to the intermediate transfer belt 20, thereby achieving good transferability for a transfer sheet having convex and concave portions such as an embossed paper.

Further, the vibration imparting part 407 of the ultrasonic vibration generating unit 400A contacts the intermediate transfer belt 20 between the position where a roller-type photoconductor transfer electric generating member contacts the intermediate transfer belt 20 and the position where the secondary transfer roller 304 contacts the intermediate transfer belt 20 in the related-art configuration. In this configuration, however, the contact position of the roller-type photoconductor transfer electric generating member is separated from the contact position of the vibration imparting part 407 of the ultrasonic vibration generating unit 400A. And, the contact position of the roller-type photoconductor transfer electric generating member is also separated from the contact position of the secondary transfer roller 304. If the photoconductor transfer electric generating member contacts the intermediate transfer belt 20 at a position apart from the secondary transfer roller 304, the flow of the secondary transfer electric current may be impaired, and the bias voltage may be increased to flow the electric current. An increase in the bias voltage can cause an excess of the upper limit of the power source capacity and electric discharging between the adjacent members.

By contrast, in the image forming apparatus 500 according to an exemplary embodiment of the present invention, the vibration imparting part 407 of the ultrasonic vibration generating unit 400 contacts the intermediate transfer belt 20 at the position intermediate between where the voltage applying brush 205 that is a brush-type photoconductor transfer electric generating member contacts the intermediate transfer belt 20 and where the secondary transfer roller 304 contacts the intermediate transfer belt 20. With this configuration, the vibration imparting part 407 can be disposed adjacent the contact position of the voltage applying brush 205. Therefore, this configuration can arrange the contact position of the photoconductor transfer electric generating member and the contact position of the secondary transfer roller 304 adjacent to each other. This can prevent problems due to a less amount of flow of the secondary transfer electric current caused by the resistance of the intermediate transfer belt 20.

Further, in the image forming apparatus 500 according to an exemplary embodiment of the present invention, the secondary transfer roller 304 serving as the second transfer electric field generator contacts the intermediate transfer belt 20 between the voltage applying brush 205 and the transfer area exit roller 204, both of which are the two adjacent first transfer electric field generators, with the transfer sheet conveyance belt 300 interposed between the secondary transfer roller 304 and the voltage applying brush 205 and the transfer area exit roller 204.

The secondary transfer bias having a same polarity as the toner is applied to the voltage applying brush 205 and the transfer area exit roller 204 and the secondary transfer roller 304 that is grounded is disposed between the voltage applying brush 205 and the transfer area exit roller 204. By so doing, the electric current flows to the grounded secondary transfer roller 304 from both the upstream and downstream sides in the direction of rotation of the intermediate transfer belt 20, and the area through which the electric current flows forms the secondary transfer electric field. By forming the secondary transfer electric field on the upstream and downstream sides from the secondary transfer roller 304, the distance of each flow of the electric current can be increased without the distance of the electric current flowing through the intermediate transfer belt 20. This can prevent problems due to a less amount of flow of the secondary transfer electric current caused by the resistance of the intermediate transfer belt 20 and can obtain a wide area for forming the secondary transfer electric field.

Then, the vibration imparting part 407 applies the ultrasonic vibrations to the intermediate transfer belt 20, which is the wide area for forming the secondary transfer electric field, so as to obtain a wider area for the transfer electric field to assure a longer period of time for the image transfer operation. Further, the application of the ultrasonic vibrations to the intermediate transfer belt 20 in the area where the transfer electric field is formed can reduce the adhesion force of toner to the intermediate transfer belt 20, thereby achieving good transferability for a transfer sheet having convex and concave portions such as an embossed paper.

Further, by reducing the distance of flow of the electric current through the intermediate transfer belt 20, the high surface resistivity of the intermediate transfer belt 20 can be set, which can prevent toner scattering in the primary image transfer operation.

Further, at least one of the surface resistivity of the outer surface and the surface resistivity of the inner surface of the intermediate transfer belt 20 used in the image forming apparatus 500 falls within a range of from $1\times10^{9}$ [Ω/square] to $1\times10^{12}$ [Ω/square].

Conventionally, when an image forming apparatus includes one photoconductor transfer electric generating member, i.e., includes the transfer roller opposed roller 214 only, the surface resistivity of the intermediate transfer belt 20 was preferably $1\times10^{10}$ [Ω/square] or smaller, more preferably $1\times10^{9}$ [Ω/square] or smaller. If the intermediate transfer belt 20 having the surface resistivity of this range is used in a tandem-type image forming apparatus, electric current flows between primary transfer bias applying members, causing current interference to result in improper toner image transfer.

By contrast, the image forming apparatus 500 according to an exemplary embodiment of the present invention includes multiple photoconductor transfer electric generating members to form a wider transfer nip for the secondary image transfer operation and employs a belt member having a relatively high surface resistivity (e.g., the intermediate transfer belt 20), and therefore can prevent toner scattering in the primary image transfer operation and provide toner image having good transfer efficiency.

Further, the secondary image transfer nip N formed in the secondary transfer part (e.g., the secondary transfer mechanism 30, 30', 30M, or 30M') of the image forming apparatus 500 serves as a recording medium transfer nip to transfer the toner image T held on the intermediate transfer belt 20 onto the transfer sheet S serving as a recording medium, thereby providing good toner image transferability to the transfer sheet S.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

a first endless transfer belt to carry a toner image thereon after a primary image transfer operation onto a surface of the first endless transfer belt during rotation of the first endless transfer belt;

first extension members around which the first endless transfer belt is extended;

at least one first transfer electric field generator disposed inside of a loop of the first endless transfer belt;

a secondary transfer unit disposed outside of the loop of and at least partially facing the first endless transfer belt to transfer the toner image onto a transfer medium conveyed by the secondary transfer unit; and an ultrasonic vibration generator to generate ultrasonic vibrations, the ultrasonic vibration generator being disposed inside the loop of the first endless transfer belt and including a vibration imparting part from which the ultrasonic vibrations are applied to an inner face of the first endless transfer belt, wherein the secondary transfer unit is disposed facing and in contact with a first surface portion of the first endless transfer belt to form a transfer nip therebetween, through which the transfer medium is conveyed when the toner image is transferred onto the transfer medium in a secondary image transfer operation, the secondary transfer unit including a secondary transfer roller that faces and contacts an inner face of a second endless transfer belt in the transfer nip to contact the first endless transfer belt via the second endless transfer belt, wherein the transfer nip has a transfer electric field due to a difference in electric potential between the first endless transfer belt and the secondary transfer unit, wherein the first transfer electric field generator contacts the inner face of the first surface portion of the first endless transfer belt in the transfer nip and the secondary transfer unit presses against the first endless transfer belt at a position along the first endless transfer belt opposite the first transfer electric field generator with the first endless transfer belt interposed therebetween, wherein the vibration imparting part of the ultrasonic vibration generator contacts the first endless transfer belt at an intermediate position between a contact point of the first transfer electric field generator with the first endless transfer belt and a contact point of the secondary transfer unit with the first endless transfer belt in a direction of rotation of the first endless transfer belt, and wherein the vibration imparting part of the ultrasonic vibration generator contacts the first endless transfer belt at a position upstream from the contact point of the secondary transfer unit with the first endless transfer belt in a direction of rotation of the first endless transfer belt.

2. The image forming apparatus according to claim 1, wherein the at least one first transfer electric field generator includes a plurality of first transfer electric field generators, wherein at least one of the first extension members around which the first endless transfer belt is extended constitutes a first field generator of the plurality of first transfer electric field generators, and wherein the secondary transfer roller is disposed at an intermediate position between the first field generator of the plurality of first transfer electric field generators and a second field generator of the plurality of first electric field generators in a direction of rotation of the first endless transfer belt.

3. The image forming apparatus according to claim 1, wherein the at least one first transfer electric field generator includes a plurality of first transfer electric field generators, and wherein the vibration imparting part of the ultrasonic vibration generator is disposed between one of the plurality of first transfer electric field generators and the secondary transfer roller.

4. The image forming apparatus according to claim 1, wherein the at least one first transfer electric field generator includes a plurality of first transfer electric field generators, and wherein the vibration imparting part of the ultrasonic vibration generator contacts the first endless transfer belt between two adjacent first transfer electric field generators of the plurality of first transfer electric field generators that contact the first endless transfer belt.

5. The image forming apparatus according to claim 4, wherein the secondary transfer unit includes a second transfer electric field generator that contacts the first endless transfer belt between at least two adjacent first transfer electric field generators of the plurality of first transfer electric field generators.

6. The image forming apparatus according to claim 5, wherein the vibration imparting part of the ultrasonic vibration generator contacts the first endless transfer belt at a position upstream of a contact point of the second transfer electric field generator with the first endless transfer belt in the direction of rotation of the first endless transfer belt.

7. The image forming apparatus according to claim 1, wherein at least one of a surface resistivity of an outer surface and a surface resistivity of an inner surface of the first endless transfer belt falls within a range of from $1 \times 10^9$ [Ω/square] to $1 \times 10^{12}$ [Ω/square].

8. The image forming apparatus according to claim 1, wherein the transfer nip transfers the toner image held on the first endless transfer belt onto a recording medium.

9. An image forming apparatus, comprising:

a first endless transfer belt that carries a toner image thereon after a primary image transfer operation onto a surface of the first endless transfer belt during rotation of the first endless transfer belt;

first extension members around which the first endless transfer belt is extended;

a plurality of first transfer electric field generators disposed inside of a loop of the first endless transfer belt;

a secondary transfer unit disposed outside of the loop of and at least partially facing the first endless transfer belt to transfer the toner image onto a transfer medium conveyed by the secondary transfer unit; and an ultrasonic vibration generator to generate ultrasonic vibrations, the ultrasonic vibration generator being disposed inside the loop of the first endless transfer belt and including a vibration imparting part from which the ultrasonic vibrations are applied to an inner face of the first endless transfer belt, wherein the secondary transfer unit is disposed facing and in contact with a first surface portion of the first endless transfer belt to form a transfer nip therebetween, through which the transfer medium is conveyed when the toner image is transferred onto the transfer medium in a secondary image transfer operation, wherein the secondary transfer unit includes a secondary transfer roller disposed facing and in contact with an inner face of a second endless transfer belt in the transfer nip to contact the first endless transfer belt via the second endless transfer belt, wherein the transfer nip has a transfer electric field due to a difference in electric potential between the first endless transfer belt and the secondary transfer unit, wherein the plurality of first transfer electric field generators contact the inner face of the first surface portion of the first endless transfer belt in the transfer nip and the secondary transfer unit presses against the first endless transfer belt opposite the plurality of first transfer electric field generators with the first endless transfer belt interposed therebetween, wherein the vibration imparting part of the ultrasonic vibration generator contacts the first endless transfer belt at a position between two adjacent first transfer electric field generators of the plurality of first transfer electric field generators that contact the first endless transfer belt, and wherein the vibration imparting part of the ultrasonic vibration generator contacts the first endless transfer belt at a position upstream of where the secondary transfer roller contacts the first endless transfer belt in a direction of rotation of the first endless transfer belt.

10. The image forming apparatus according to claim 9, wherein at least one of the first extension members around which the first endless transfer belt is extended constitutes a first field generator of the plurality of first transfer electric field generators, and wherein the secondary transfer roller is disposed at an intermediate position between the first field generator of the plurality of first transfer electric field generators and a second field generator of the plurality of first transfer electric field generators in the direction of rotation of the first endless transfer belt.

11. The image forming apparatus according to claim 9, wherein the vibration imparting part of the ultrasonic vibration generator is disposed between one of the plurality of first transfer electric field generators and the secondary transfer roller.

* * * * *

UNITED STATES PATENT AND TRADEMARK OFFICE

CERTIFICATE OF CORRECTION

PATENT NO. : 8,682,236 B2
APPLICATION NO. : 12/725033
DATED : March 25, 2014
INVENTOR(S) : Yuuji Sawai It is certified that error appears in the above-identified patent and that said Letters Patent is hereby corrected as shown below:

On the title page, Item (75), the Inventor's Last Name is incorrect. Item (75) should read:

--(75) Inventor: Yuuji Sawai, Yokohama (JP)--

Signed and Sealed this
Twenty-fourth Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,682,236 B2
APPLICATION NO. : 12/725033
DATED : March 25, 2014
INVENTOR(S) : Yuuji Sawai It is certified that error appears in the above-identified patent and that said Letters Patent is hereby corrected as shown below:

On the title page, Item (12), delete "Sawaj" and insert --Sawai--

On the title page, Item (75), the Inventor's Last Name is incorrect. Item (75) should read:

--(75) Inventor: Yuuji Sawai, Yokohama (JP)--

This certificate supersedes the Certificate of Correction issued June 24, 2014.

Signed and Sealed this
Fifth Day of August, 2014

Michelle K. Lee

Michelle K. Lee
*Deputy Director of the United States Patent and Trademark Office*